US005326223A

United States Patent [19]

Speer

[11] Patent Number: 5,326,223

[45] Date of Patent: Jul. 5, 1994

[54] AUTOMATIC VARIABLE PITCH MARINE PROPELLER WITH MECHANICAL HOLDING MEANS

[76] Inventor: Stephen R. Speer, N. 14924 Edencrest Dr., Spokane, Wash. 99208

[21] Appl. No.: 60,807

[22] Filed: May 12, 1993

Related U.S. Application Data

[60] Division of Ser. No. 692,206, Apr. 26, 1991, Pat. No. 5,240,374, which is a continuation-in-part of Ser. No. 645,096, Jan. 24, 1991, Pat. No. 5,129,785, which is a continuation-in-part of Ser. No. 376,112, Jul. 6, 1989, Pat. No. 5,032,057, which is a continuation-in-part of Ser. No. 216,014, Jul. 7, 1988, Pat. No. 4,929,153.

[51] Int. Cl.[5] ..... B63H 3/00

[52] U.S. Cl. ..... 416/46; 416/43; 416/89; 416/136; 416/139; 416/140

[58] Field of Search ..... 416/43, 44, 89, 135, 416/136, 139, 140, 46

[56] References Cited

U.S. PATENT DOCUMENTS

| | | | |
|---|---|---|---|
| 1,970,114 | 8/1934 | Wiegand | 416/136 R |
| 2,415,421 | 2/1947 | Defilippis . | |
| 2,528,609 | 11/1950 | Rouse . | |
| 2,608,257 | 8/1952 | Godfrey . | |
| 2,694,459 | 11/1954 | Biermann . | |
| 2,949,966 | 8/1960 | Simshauser | 416/135 |
| 2,988,156 | 6/1961 | Coleman | 416/136 R |
| 3,177,948 | 4/1965 | Reid | 416/44 |
| 3,231,023 | 1/1966 | Marshall | 416/43 |
| 3,321,023 | 5/1967 | Russell et al. | 416/140 R |
| 3,567,336 | 3/1971 | Bartha | 416/136 R |
| 4,419,050 | 12/1983 | Williams . | |
| 4,792,279 | 12/1988 | Bergeron | 416/89 |
| 4,984,967 | 1/1991 | Cruzen . | |
| 5,022,820 | 6/1991 | Bergeron | 416/153 |
| 5,219,272 | 6/1993 | Steiner et al. | 416/139 |

FOREIGN PATENT DOCUMENTS

| | | | |
|---|---|---|---|
| 467488 | 1/1937 | United Kingdom . | |
| 567372 | 2/1945 | United Kingdom | 416/136 R |

*Primary Examiner*—Edward K. Look
*Assistant Examiner*—James A. Larson

[57] ABSTRACT

There is provided a self-actuating variable pitch marine propeller which incorporates two or more blades, each independently rotatable, relative to the propeller hub, between a first lower and a second higher pitch. The blades are preferably mechanically linked by coordinating devices and are caused to move preferably by a combination of centrifugal force effect resulting from inertial masses means and the hydrodynamic forces acting upon the blade hydrodynamic surface. The rotation of the blades relative to the propeller hub is restrained until the restraint is overcome by the forces acting to pivot the blades to the higher pitch position. Most preferably there is also provided a mechanical bias, such as a spring to hold the blades in the lower pitch position. Initially, the hydrodynamic force can also tend to hold in the blades in the lower pitch position, or to move the blades towards the higher pitch.

8 Claims, 37 Drawing Sheets

AUTOMATIC VARIABLE PITCH MARINE PROPELLER WITH MECHANICAL HOLDING MEANS

This is a divisional of U.S. Pat. No. 5240,374 Application Ser. No. 07/692,206, filed Apr. 26, 1991, which is a continuation-in-part of application Ser. No. 645,096, filed Jan. 4, 1991, and now U.S Pat. No. 5 129,785 which is a continuation-in-part of application Ser. No. 376,112, filed Jul. 6, 1989 now U.S. Pat. No. 5,032,057, which is a continuation-in-part of Ser. No. 216,014, filed Jul. 17, 1988 and now U.S. Pat. No. 4,929,153.

This invention relates to self-actuating variable pitch marine propellers wherein the blade pitch is automatically variable from one pitch operational position to another operational position, and wherein the speed of the rotational pitch change movement of the propeller blades is limited by viscous damping.

In prior art, such as presented in U.S. Pat. No. 2,998,080, by Moore, and U.S. Pat. No. 4,792,279, by Bergeron, the rotational movement of the blade is determined by cam grooves, which impose substantially a helical relationship between the rotational and translational motions of the blade shafts along their entire length.

As becomes quickly evident in use, one of the basic problems with all prior art self-actuating variable pitch propellers which do not incorporate any blade pitch position locking or holding means, is that the blade positioning tends to become unstable, i.e., the blade tends to oscillate, or flutter. This is of particular concern in marine propeller design concepts intended to provide infinite adjustability in pitch position between operably preset low and high pitch limits. Examples of such concepts include U.S. Pat. No. 2,682,926 to Evans and, more recently, U.S. Pat. No. 4,792,279 to Bergeron.

Prior art, for example, U.S. Pat. No. 3,177,948 by Reid, mentions the concept of damping the movement of counterweights which cause pitch change so that the weight movements are smoothed, by being immersed into a volume of lubricating oil. But Reid fails to recognize that damping means are needed to control the rate at which the blades are allowed to change position, and thus to prevent flutter, resulting from unstable blade positioning. Further, the concept presented by Reid does not provide any specific damping control means, but simply utilized viscosity drag that results from a complete immersion of the propeller actuating mechanism in lubricating fluid, to smooth out the movement of the weights.

Design concepts intended primarily for aircraft use that provide means to hydraulically hold the propeller blades alternately in one of two discrete blade pitch positions are presented in U.S. Pat. No. 2,694,459 by Biermann and in German Appln. No. 3,429,297, pub'd. on Feb. 20, 1986. These concepts utilize hydraulic control valves which inherently have flow restriction when opened. As a consequence of channeling the hydraulic fluid through the valves, inherent viscous damping may be generated at sufficient magnitude to reduce blade flutter in aircraft propellers. However, the unique concept of providing a large magnitude of damping to reduce the rotation velocity of the marine propeller blade is not recognized.

Instability in blade positioning generally is the result of continual changes in hydrodynamic loads acting on the propeller blade surfaces. The hydrodynamic load changes may oscillate at a frequency close to the normal vibration modes of the blade positioning mechanism, thereby inducing flutter. The blade flutter vibrations can be quite severe, even causing damage to the propeller or drive system.

Infinitely variable pitch propellers are especially prone to flutter problems, because of the unrestrained motion of the blades over a wide pitch range, coupled with a wide range in engine and propeller speeds; this combination makes it likely that one or more of the applied forcing frequencies is sufficiently close to one or more of the natural frequencies of the blade positioning systems to cause the undesirable harmonic effect of flutter.

Another problem with these infinitely variable pitch propeller designs is that they are inconsistent with respect to changing pitch at a specified operating parameter. This lack of precision is generally caused by the dramatic changes which can occur in the hydrodynamic loads acting on the propeller blades at any given operational pitch condition. For example, unless the blade shank is located forward on the blade, i.e., near or within the 25% mean chord position, when a large amount of engine power is quickly applied to a boat at rest, i.e., the boat is sharply accelerated, the hydrodynamic loads acting on the blade surfaces forward of the shaft, will dominate and prematurely cause the blades to rotate towards a higher pitch until physically restrained by the high pitch limit stop. Alternatively, if very high force springs are used to bias and hold the blades in the low pitch position, in an attempt to counterbalance these hydrodynamic loads and thus prevent this premature shift in blade pitch position, high flutter instabilities become even more likely. Also, with a large spring return force, premature downshifting back to the low pitch limit position is also likely to occur with only a small reduction in engine power, which could cause overspeed of the engine. Finally, if excessively high force bias springs are utilized, the forces to rotate the blades may not be able to overcome the bias force, so that the propeller will act as a conventional fixed pitch propeller.

General objects

It is an object of the present invention to provide, especially for a marine propeller, dependable self-actuating means for pitch changing between relatively low and relatively high pitch operational positions, for example, for shifting between a first, lower discrete pitch blade operational position, and another, higher pitch blade position, with changes in such boat operating conditions as engine RPM and boat speed and/or boat acceleration. It is a further object of the invention to provide dependable, self-actuating pitch-changing means that will change, with minimal oscillational instabilities, in response to achieving a predetermined boat speed, and preferably which, at least over a portion of the desired pitch range, varies substantially continuously based upon the rate of acceleration. It is yet another object of this invention to provide means to automatically change marine propeller pitch substantially continuously within the most nearly optimal engine speed range.

A still further object of this invention is to provide a self-actuated propeller blade pitch-shifting mechanism for shifting the blades substantially continuously through a defined range of pitch positions in response to predetermined inertial conditions, and to avoid blade flutter and/or propeller RPM hunting during boat operation regardless of changes in blade hydrodynamic load on the propeller blade. It is yet another object of the present invention to provide for automatic pitch shifting in a replaceable propeller which is self-contained and thus capable of being interchanged with a fixed pitch propeller without otherwise modifying the engine or propeller drive system, and which includes a flexible coupling between the drive shaft and propeller.

The concept of providing discrete operational pitch positions as presented in U.S. Pat. No. 4,929,153, by Speer, and in the copending applications provide means for stable and connected operation of self actuating variable pitch marine propeller. This is accomplished by providing means to restrain the angular and/or radial position of the blades. In the present alternate approach, a restraint is applied to the rate-of-change in blade position to control any oscillation in blade pitch position and to prevent flutter. The means for restraining the rate-of-change in position is generally referred to as damping.

General Description of the Invention

This invention presents a self-actuating variable pitch marine propeller which incorporates two or more blades, which are independently rotatable relative to the propeller, and fluid control damping means for restricting the rotation of the blades and thus to reduce or eliminate flutter. The blades preferably have cylindrical shafts which are rotatably connected to a central hub of the propeller via, e.g., cylindrical joints.

Preferably, the blades are all mechanically linked by coordinating means, such that the blades all move in unison and to the same degree. The viscous damping can be provided between the individual blades and the propeller hub, or damping means can be provided linked to the coordinating means.

In one embodiment, the blades are caused to rotate about the blade shaft, or shank, axis as a result of the blades being caused to translate radially, relative to the central hub, by for example, the centrifugal force effect resulting from the rotation of the propeller. In the operation of this embodiment, as the propeller rotational speed (about the hub and drive shaft axis) increases, centrifugal forces so generated increase, and act on each blade mass creating a radially outward force. This radially outward force effect, upon reaching a sufficient magnitude, causes the blades to move radially outward. A blade positioning mechanism connected between each blade and the hub, and preferably located within the hub, directs the blades to rotate, e.g., to a higher pitch angle, as the blades move radially outward.

In other embodiments, the blades are directly caused to rotate, e.g., to a higher pitch angle, by hydrodynamic force torques generated on the blades as they rotate, and/or by centrifugal force effects generated by ancillary masses, or counterweights, secured to the blades, which cause the blades to rotate about the blade axis, as the ancillary masses are rotated about the drive shaft axis, so that the blades rotate without radial movement.

In all cases, the blades are operably linked by coordinating means and are also preferably biased towards the low pitch position, and, if necessary, radially inward. Such biasing can be accomplished by mechanical design constraints, e.g., spring forces, and/or, e.g.,hydrodynamic loads. It is noted that it is well known that blades can be designed so that the direction of the torque generated by the hydrodynamic forces can change as the location of the blade center of pressure changes,e.g., from one side of the blade shaft axis to the other side, during changes in blade operating parameters. This is explained more fully in my U.S. Pat. No. 5,129,785.

There can optionally be further provided holding means to retain, or hold, the blades at least in one discrete pitch position; the holding means is designed such that at a sharply defined combination of parameters, including rotational speed and, optimally, hydrodynamic load on the blades, the blades are released and permitted to move to a second pitch position. The providing of a holding means, especially at the starting low pitch position, to retain the blades in a discrete position, is preferred, because the shift in blade pitch position, e.g., to a higher pitch position, can be made to be more consistent and stable. This holding means can be mechanical, as is explained in U.S. Pat. No. 5,129,785, or as part of the viscous damping system.

BRIEF DESCRIPTION OF THE DRAWINGS

A further understanding of the present invention can be obtained by reference to the preferred embodiments set forth in the illustrations of the accompanying drawings. These embodiments are merely exemplary, and are not intended to limit the scope of this invention. Each drawing depicting the operating mechanism of the propeller of this invention is within itself drawn to scale, but different drawings may be drawn to different scales. Referring to the drawings:

I

k

FIG. 32 shows a restraining means, i.e., a backward canted pocket, for the radially inward, low pitch operational position, in combination with a radially outward helical groove (allowing the propeller to operate as an infinitely variable pitch position device once the blades have been caused to be released from a discrete low pitch angular position); FIG. 31 depicts a helical cam groove, i.e. an infinitely variable system, which does not include a pocket;

DETAILED DESCRIPTION OF THE INVENTION

Figure 1:
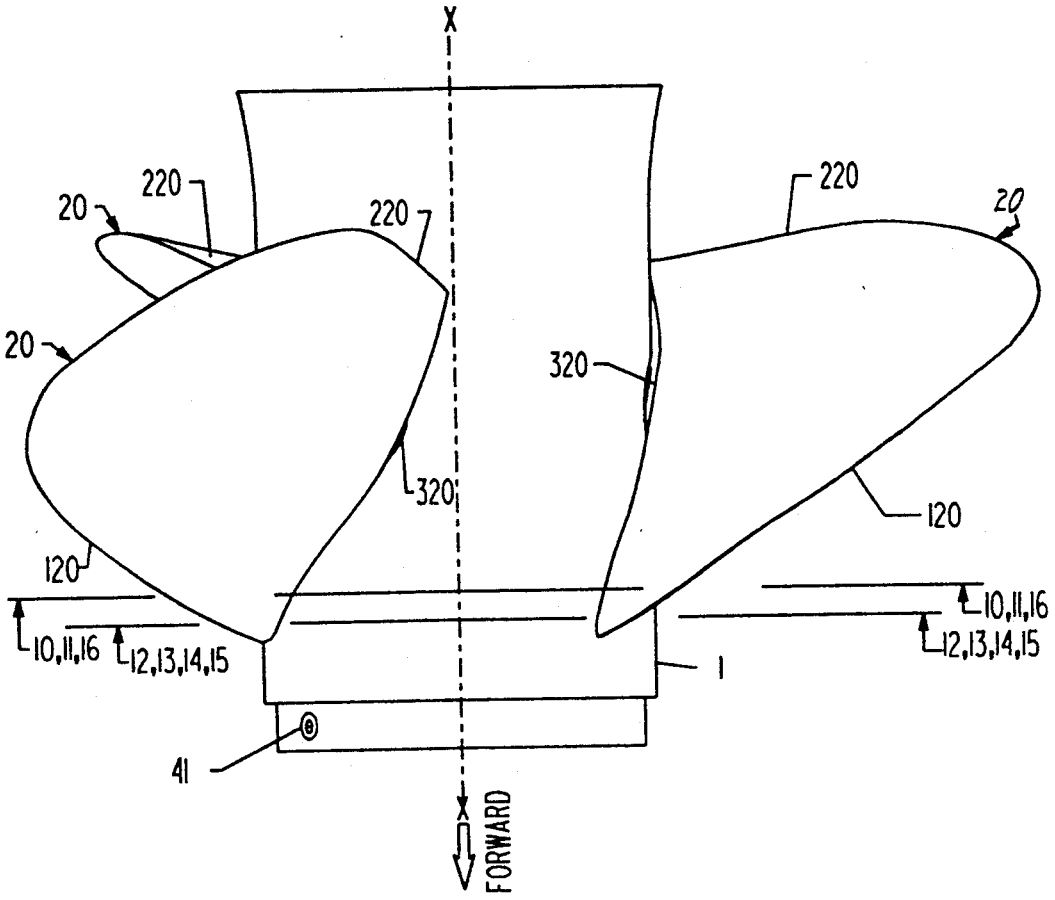
FIG. 1 is a side elevation view of a variable pitch marine propeller assembly.
Figure 2:
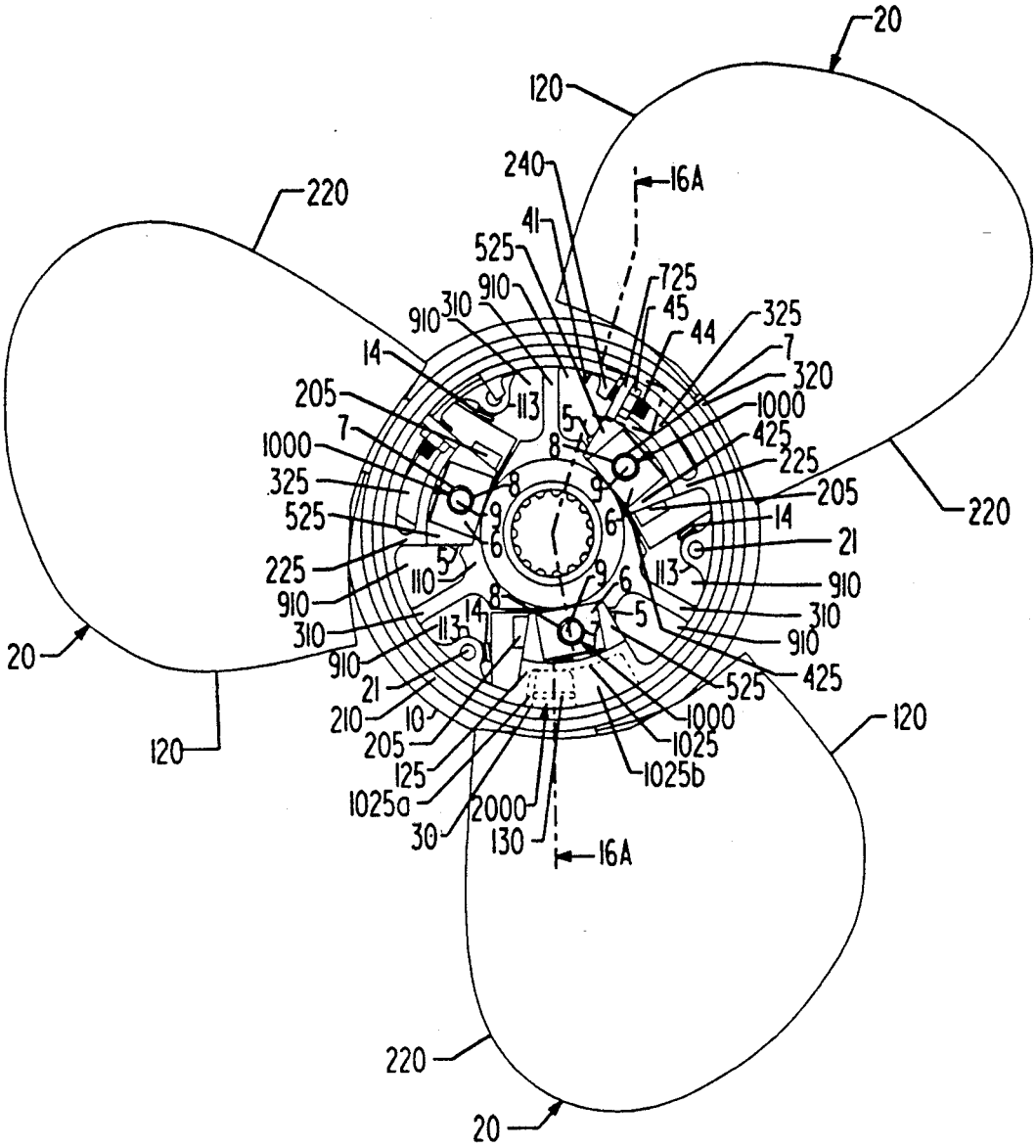
FIG. 2 is a front elevation view of one embodiment of the propeller assembly of this invention having a rotating coordinating ring and a viscous damping device, with the internal mechanism and blades located in the low pitch operational position.
Figure 3:
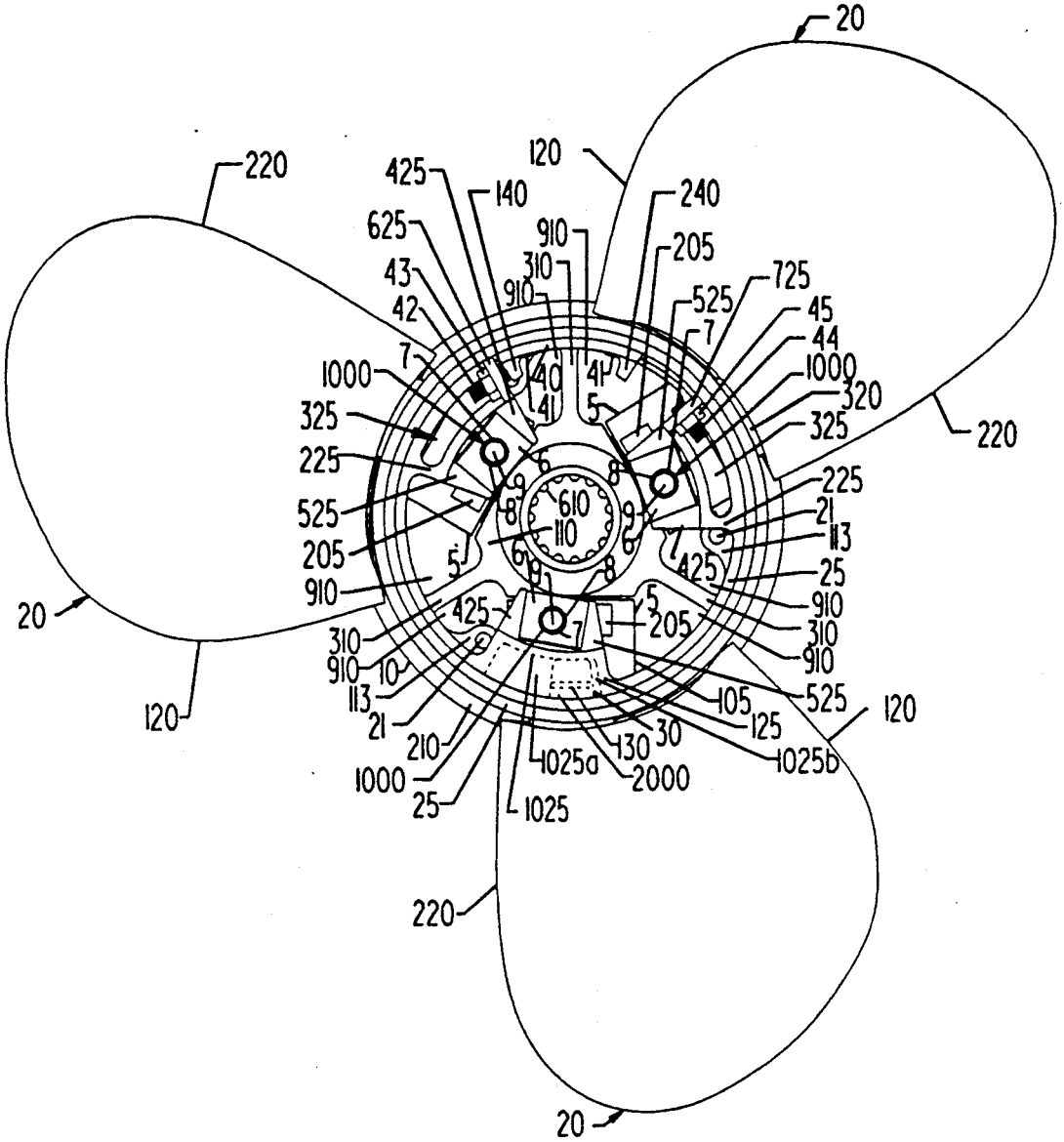
FIG. 3 is the front elevation view of the embodiment of FIG. 2, with the internal mechanism in the high pitch position.
Figure 4:
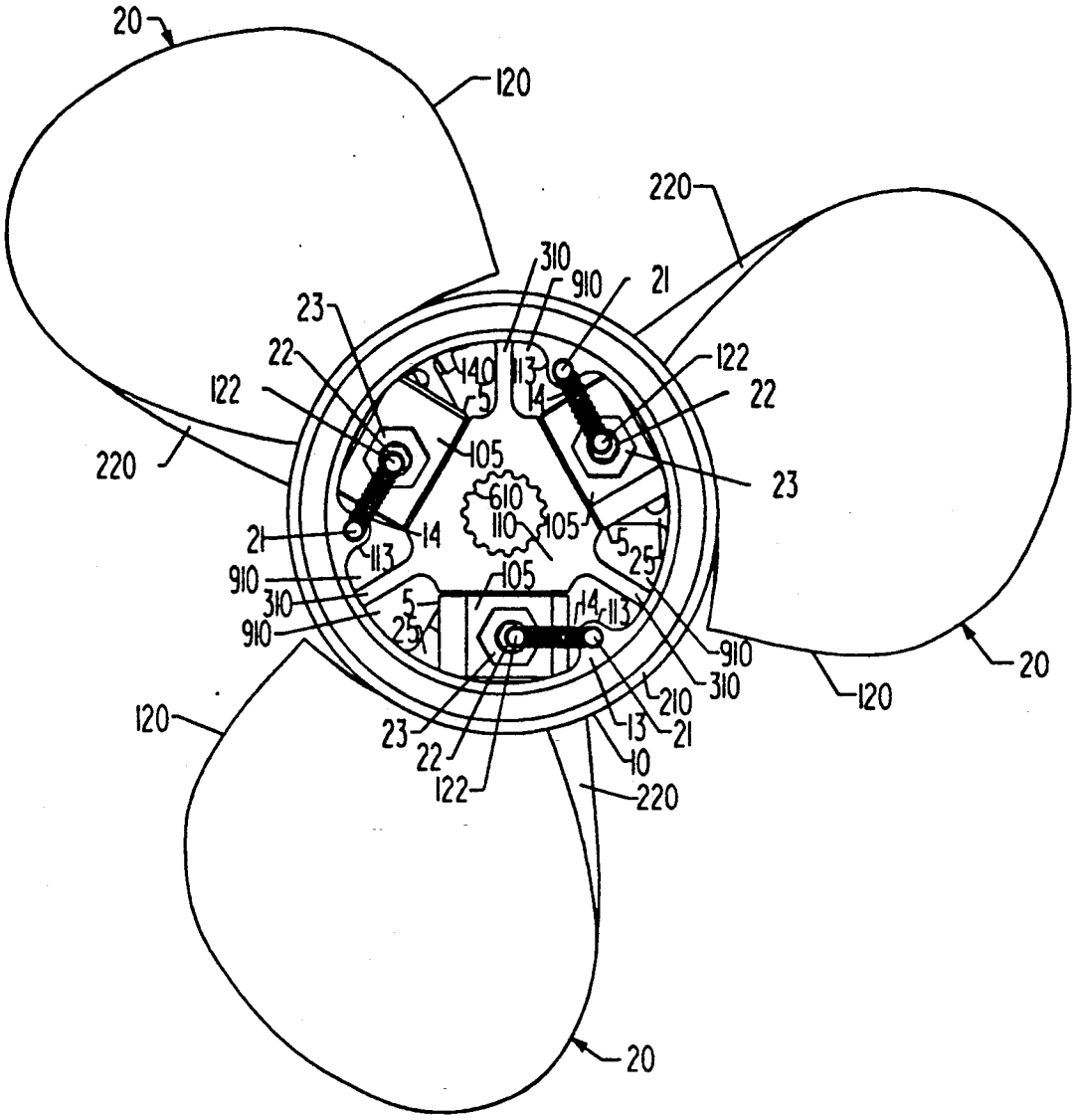
FIG. 4 is a rear view of the propeller assembly of FIG. 2 with the internal mechanism and blades in the low pitch limited position.
Figure 5:
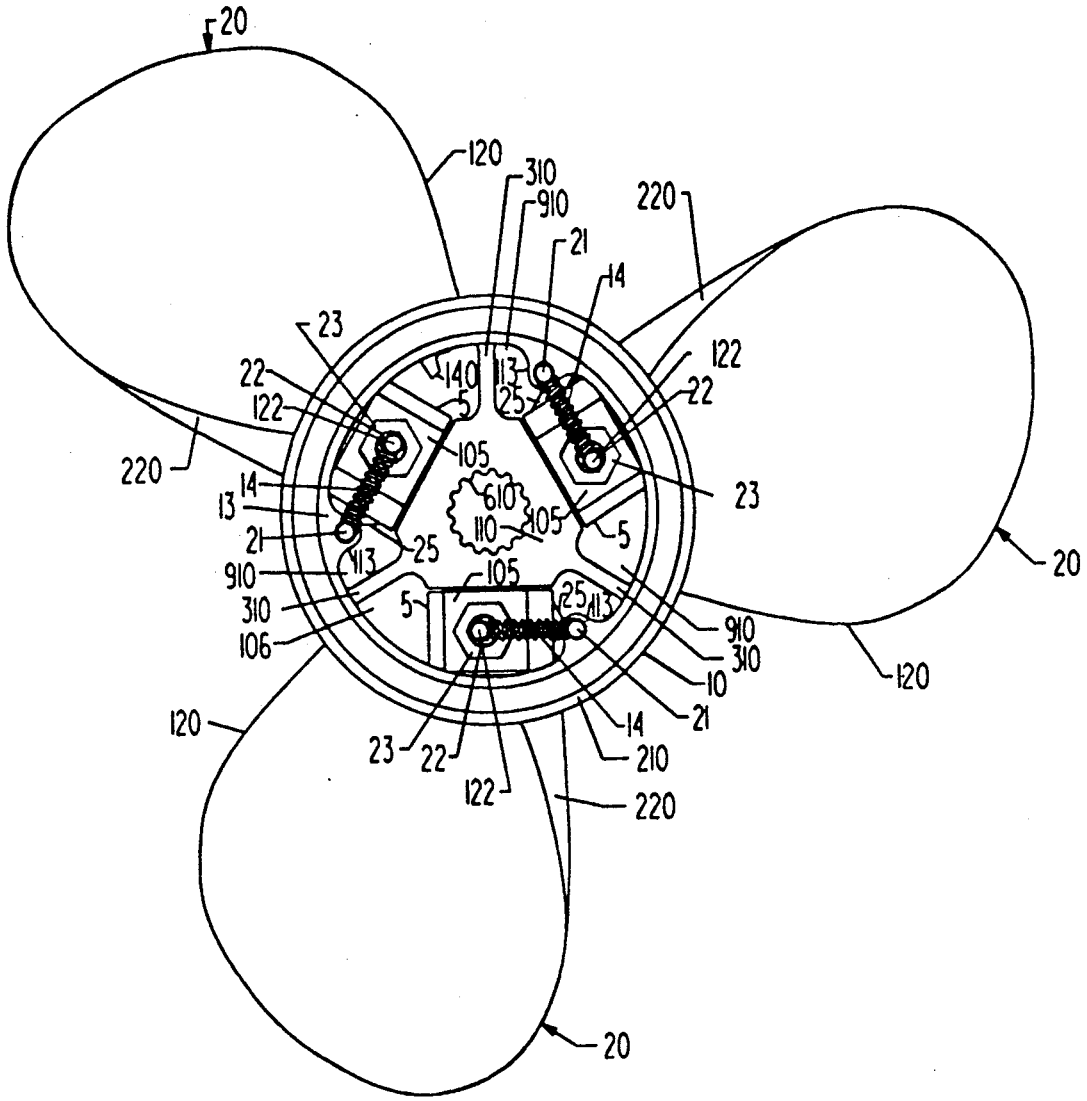
FIG. 5 is the rear view of the propeller assembly of FIG. 3 with the internal mechanism and blades in the high pitch limited position.

A first embodiment of the variable pitch propeller of this invention, wherein restricted fluid flow is utilized as a primary means for controlling the rate-of-change in blade pitch positions, is shown in FIGS. 1 and 2 through 9.

Referring to these Figures. a hub, generally indicated by the number 10, is rotatably connected to three substantially identical propeller blades, generally indicated by the numeral 20. This propeller is designed to be detachably secured, without any further changes, to an outboard engine or stern drive system in place of a conventional fixed blade propeller. The present invention can also be fitted to an inboard engine drive shaft.

Concentrically located within and fixed to the hub case 210 is an inner hub, generally indicated by the numeral 110. The inner hub 110 also contains splines 610 on its interior surface, providing a torque transmission coupling to the propulsion system drive shaft, not shown, which has mating splines. The inner hub 110 is affixed to the outer hub case 210 by torque transmitting spoke members 310. Between the spoke members 310 are defined a set of parallel passages 910, through which engine exhaust gasses may flow.

The blades 20 comprise blade hydrodynamic surfaces which are secured to a retainer shaft 320, extending radially inward through the hub case 210 (detail view of the blades are shown as FIGS. 21*a*–22*c*). The hydrodynamic surfaces include a positive pressure surface 20*a* and a negative pressure surface 20*b*, each located between the blade leading edge 120 and the trailing edge 220. Each blade retainer shaft 320 is journalled through the outer hub case 210 and into the inner hub 110, and is supported by journal bearings 11 and 12, located in inner hub cavity 410 and then outer hub bore 510, respectively.

A blade arm generally indicated by the numeral 5, located between the inner hub 110 and the outer hub case 210, is secured to each blade shaft 320 by an attachment stud 22. Each blade arm 5 thereby being allowed to pivot, or rotate, together with the respective blade shaft 320 within the interior of the hub 10. The attachment stud 22 has a rounded hemispheric forward end 222 which is inserted into a rounded cavity 420 formed in the side of the shaft 320. The stud 22 is also externally threaded adjacent the rounded end 222, which threads mate with internal threads contained within a bore formed through the aft portion 105 of the arm 5. A lock nut 23 is used to further secure the stud 22 to the arm 5.

The opposite or aft end of the attachment stud 22 comprises a cylindrical post extension 122, connected to one end of a tension spring 14. The second end of the tension spring 14 is connected to a pin 21 which is secured to a boss 113 provided on a spring retainer ring 13. The spring retainer ring 13 is releasably secured to the internal surface of the outer hub case 210, as by screws. Releasing the screws and manually rotating the spring retainer ring 13 provides means for adjusting the spring biasing torque applied about the blade shafts 320 by the tension spring 14, through the blade arm 5. The arrangement provided in FIGS. 2 through 9 provides a spring biasing torque tending to bias the blades 20 toward a lower angle of pitch.

Each blade arm 5 has an extension 205 projecting forwardly within the hub 10, in a direction generally parallel to the propeller drive shaft axis X. The forward end of the arm extension 205 is connected to a rotating coordinating ring 25 via a multi-degree-of-freedom joint, generally indicated by the number 1000. The arrangement of the multi-degree-of-freedom joint 1000 is such that rotation of a blade 20 and its attached blade arm 5 about the blade shaft axis Y causes the coordinating ring 25 to correspondingly rotate about the drive shaft axis X.

For the embodiment shown in FIGS. 2 through 9, the multi-degree-of-freedom joint 1000 consists of an arm shaft 9 which is fixed at one end to the forward end of the blade arm extension 205, and at the other end to a ball rotatably held within a socket provided in a slide block 6. The ball 7 and the slide block 6 assembly is held stationary axially relative to the arm forward shaft 9 by front and rear stop rings 8, held within two grooves provided in the shaft 9 on either side of the ball 7. The slide block 6 is held laterally between two opposed slide supports 425 and 525, provided on the coordinating ring 25. The opposing surfaces of the supports 425, 525 and the mating surfaces on the slide block are parallel, thus allowing the slide block to slide in both radial and axial directions, relative to the coordinating ring 25.

The multi-degree-of-freedom joint 1000 functions as follows:

If a torque is applied about the blade shaft axis Y, sufficient to cause the blade 20 and arm 5 assembly to rotate, the coordinating ring 25 is also caused to rotate via a force transmitted along the arm shaft 9, to the ball 7, the block 6 and the coordinating ring support 425 (or 525, depending upon the direction of the applied torque).

As the coordinating ring 25 and blade arm 5 each rotate, ball 7 is also caused to rotate within the socket provided in block 6, and the slide block 6 can also be caused to slide in both a radial and axial direction, between the two coordinating ring supports 425 and 525, as a consequence of the rotational relationship between the coordinating ring 25 and the axis of rotation of the blade shaft 320.

It should be mentioned that the multi-degree-of-freedom joint 1000 composed of the pin 9, the ball 7, the slide block 6 and the slide supports 425, 525, can be replaced with mating bevel gear segments at each blade/coordinating ring joint location. This alternate multi-degree-of-freedom joint 1000 configuration would consist of one bevel gear segment being attached or integral to the coordinating ring 25 at appropriate locations for each blade, with mating bevel gear segments being attached to, or integral with, each blade arm 5, replacing the arm shaft 9.

The joint 1000 connecting each blade arm 5 with the coordinating ring 25 provides an interconnection to cause all blades 20 to move in unison; the coordinating ring 25 is caused to rotate about the drive shaft axis, moving all of the blades 20 substantially simultaneously and to the same degree.

A viscous damping device, generally indicated by the number 2000, is provided between the coordinating ring 25 and hub 10 to provide damping to the rotational motion of the coordinating ring 25. This damping device is incorporated within a raised region 125 provided on the coordinating ring 25. This raised region 125 on the coordinating ring 25 is also positioned radially outward from one of the blade forward arms 5.

An external cavity 1025 is provided in the outer surface of the coordinating ring 25, and is bounded by an inner surface 1125 of the raised region 125. A vane 30, configured to sealingly mate with the inner surface 1125 is positioned inside the cavity 1025 and is sealingly secured. to the inner surface of the outer hub case 210 by threaded bolts 31. The vane 30 effectively sealingly partitions the cavity 1025 into two smaller cavities, 1025*a* and 1025*b*. A relatively narrow orifice flow channel 130 is located through the vane 30 to provide a fluid flow connection between the two smaller cavities 1025*a* and 1025*b*. The cavities 1025*a* and 1025*b* are filled with a viscous fluid. Ring seals 28, 29 are provided at the outer edges of the coordinating ring 25 to prevent leakage of the viscous fluid between the ring 25 and the hub case 10.

The arrangement of this damper geometry is such that as the coordinating ring 25 is caused to rotate between the high pitch and low pitch positions, the viscous fluid contained within the cavity portions 1025*a* and 1025*b* is forced through the orifice channel 130, within the vane 30. The two parts of the cavity are otherwise sealed from each other.

If the motion of the blades 20 is towards a higher angle of pitch, viscous fluid is forced from cavity 1025*b*, through the channel 130 and into cavity 1025*a*, as the ring rotates relative to the hub 10 in the indicated direction. Conversely, if the motion of the blades 20 is towards a lower angle of pitch, viscous fluid is forced from cavity 1025*a* through channel 130 and into cavity 1025*b*, as the ring rotates in the opposite direction.

The viscosity of the fluid contained in the cavities 1025*a,b* and the cross sectional area of the orifice channel 130, determines the amount of damping impedance imposed on the rate-of-change in angular position of the coordinating ring 25; thus, indirectly, imposing a damping impedance to the rate-of-change in pitch positions of the blades 20 which mechanically move together with the ring 25.

Adjustable angular stops are provided between the coordinating ring 25 and outer hub region 210, to limit the extreme angular positions of the coordinating ring 25 and correspondingly, the extreme low and high pitch positions of the blade. The low pitch limit means are provided by an adjustment screw 44 on the ear 725 extending forward from the coordinating ring 25; a lock nut 45 is provided to retain the position of the adjustment screw 44. When the propeller blades 20 are positioned in the low pitch limited position, as shown in FIGS. 2,4,6 and 8, one end of the adjustment screw 44 contacts pitch stop boss 240, which is secured to the outer hub case 210, by screws 41. The high pitch limit means are provided by a second adjustment screw 42 located on the ear 625, also extending forward from the coordinating ring 25; another lock nut 43 retains the position of the adjustment screw 42. When the propeller blades 20 are positioned in the high pitch limited position, as shown in FIGS. 3,5,7 and 9, one end of the adjustment screw 42 contacts the pitch stop boss 140, also secured to the outer hub case 210.

In the embodiment shown in FIGS. 2 through 9, a single rotational damper 2000 is incorporated into the coordinating ring 25, located radially outward from one of the blade arm connection joints 1000; if additional damping is required, additional dampers 2000 can be incorporated, e.g. adjacent and radially outward from one or more of the other blades.

To preserve the rotational balance of the propeller assembly when only a single damper is provided, the mass volume of the raised regions 125 and 225, vane 30 (and pitch stop segment 40), e.g., can be sized accordingly.

Figure 22B:
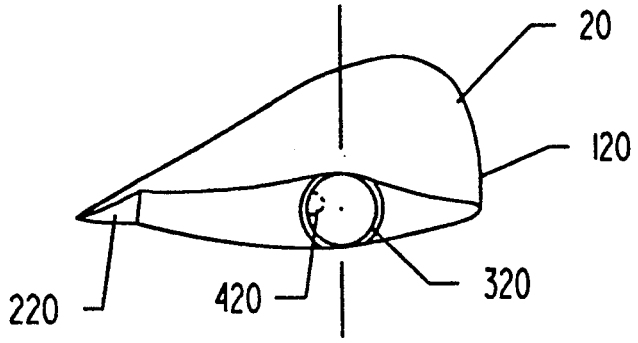
FIG. 22*b* is a top view of the propeller blade in FIG. 22*a*, looking radially outward along the blade shaft axis Y.
Figure 22A:
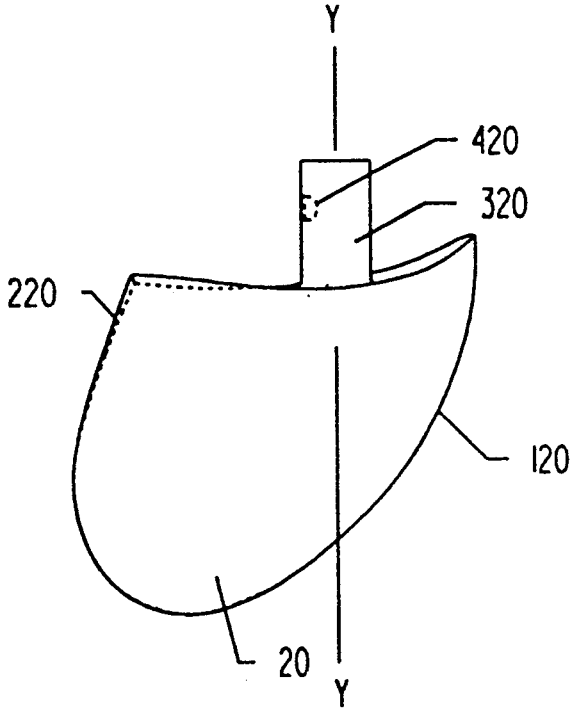
FIG. 22*a* is a side elevation view of a typical propeller blade for use in some other embodiments of FIGS. 2–9, of the invention, wherein the shaft is located aft of the blade center of pressure.
Figure 22C:
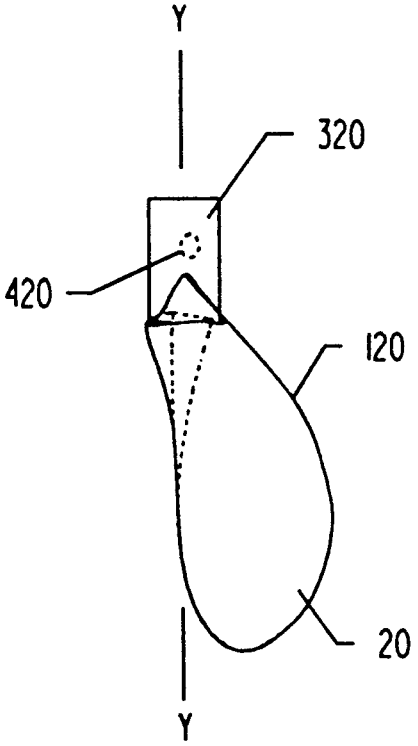
FIG. 22*c* is a rear view of the propeller blade in FIG. 22*a;*

For the particular embodiment shown in FIGS. 2 through 9, the blade pivot axis, Y, is positioned aft on the blade, near the 60% mean chord position as illustrated in FIGS. 22*a*, 22*b* and 22*c*. This extreme aft location of the shaft axis Y results in the hydrodynamic loads being imposed on the propeller forwardly of the shaft axis Y during acceleration or cruise operation of the boat, and thus, the hydrodynamic forces on the propeller blade 20 provide a torque about the blade shaft axis Y tending to rotate the blades 20 toward a higher angle of pitch at higher speeds.

The operation of the first embodiment of the propeller shown in FIGS. 2 through 9 is as follows: with the engine and propeller at idle or at a low rotational speed (RPM) the biasing tension force of the three springs 14 position the three blade arms 5, the three blades 20, and the coordinating ring 25 at the low pitch limit position, as shown in FIGS. 2,4,6 and 8. Upon increasing the engine power and propeller rotational speed (RPM), the hydrodynamic forces acting on the blades tend to rotate the blades towards a higher angle of pitch, opposing the torque biasing effect of the springs 14 and, any inertial force torque effect from the blade mass, and friction.

Once a sufficiently high hydrodynamic force torque acting towards a higher angle of pitch has been attained, overcoming the bias forces of the springs 14, the propeller blades 20 begin to move towards a higher angle of pitch. The interconnections of each of the blades 20 with the coordinating ring 25, causes the coordinating ring 25 to rotate; the rate at which the coordinating ring 25 and blades 20 can rotate is a function of the magnitude and position of the hydrodynamic loads and the magnitude of the damping provided by the rotating damper 2000. It is generally desired to provide sufficient damping effect such that under normal full power acceleration conditions, the time required for the hydrodynamic loads to cause rotation of the blades from the low pitch limited position to the high pitch limited position provides sufficient acceleration time to attain a specific cruising speed, or, alternatively, to move a specific linear distance through the water.

Operational intermediate positions of the blades between the low pitch limited position and the high pitch limited positions can be established by the equilibrium of all twisting moments acting about the blade shaft axis Y. The blade equilibrium position established is dependent on the following major factors: the geometry of the blades and shaft location, the level of power applied, the propeller rotational speed, the boat speed, the boat weight and hull drag, blade hydrodynamic loads, blade positioning mechanism internal friction, damping and spring bias. It is generally preferred that the primary biasing means tending towards a higher angle of pitch, provide significant magnitude of forces to hold the blades at the high pitch limited position once the desired cruise speed has been achieved. For the embodiment shown in FIGS. 2 through 9, the hydrodynamic loads acting on the blade 20 forward of the blade shaft axis Y are the primary biasing means to position the blades 20 toward the high pitch limit position.

Figure 6:
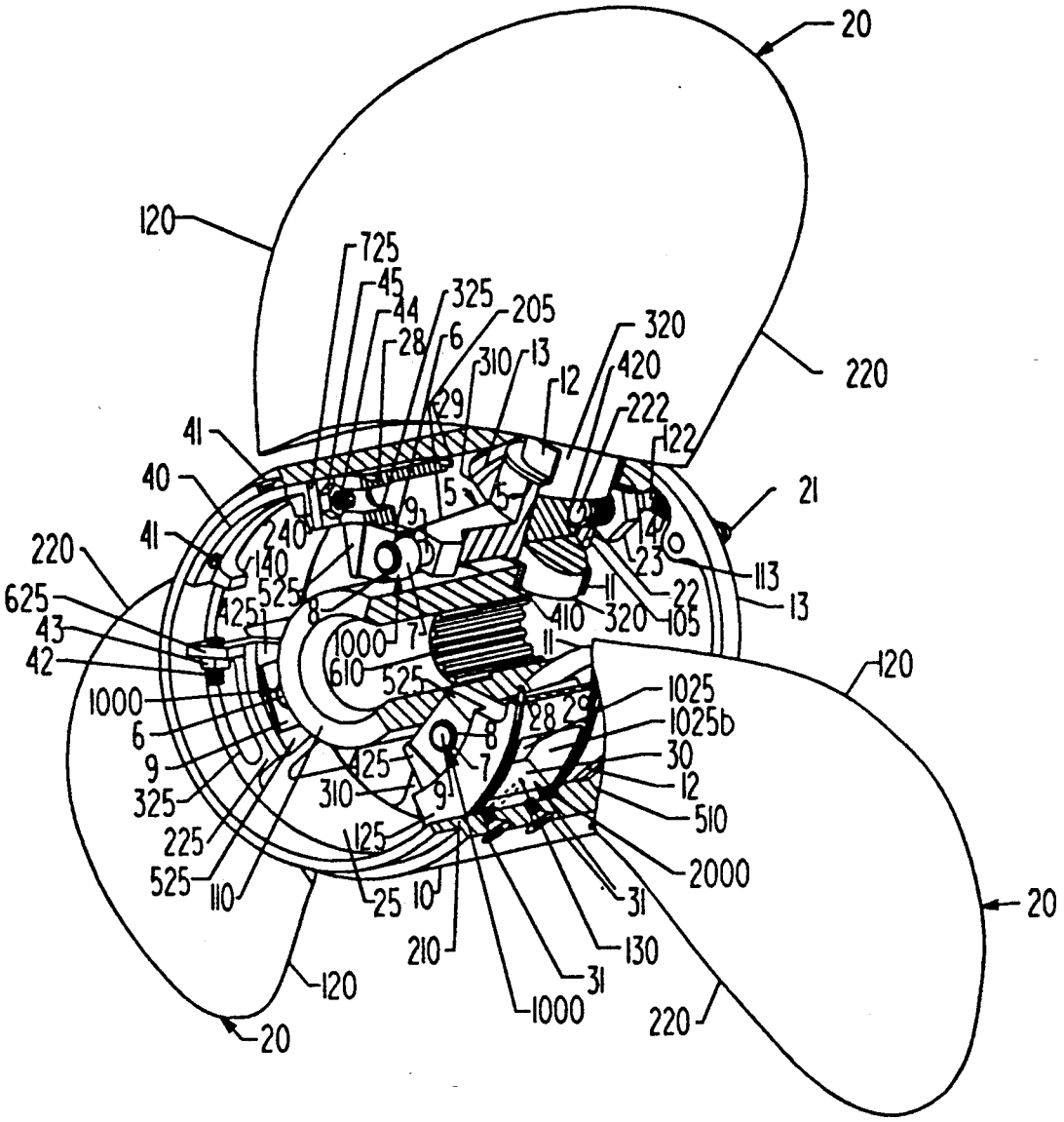
FIG. 6 is a sectional isometric view of the embodiment of FIG. 2 of this invention with the internal mechanism in the low pitch position.
Figure 7:
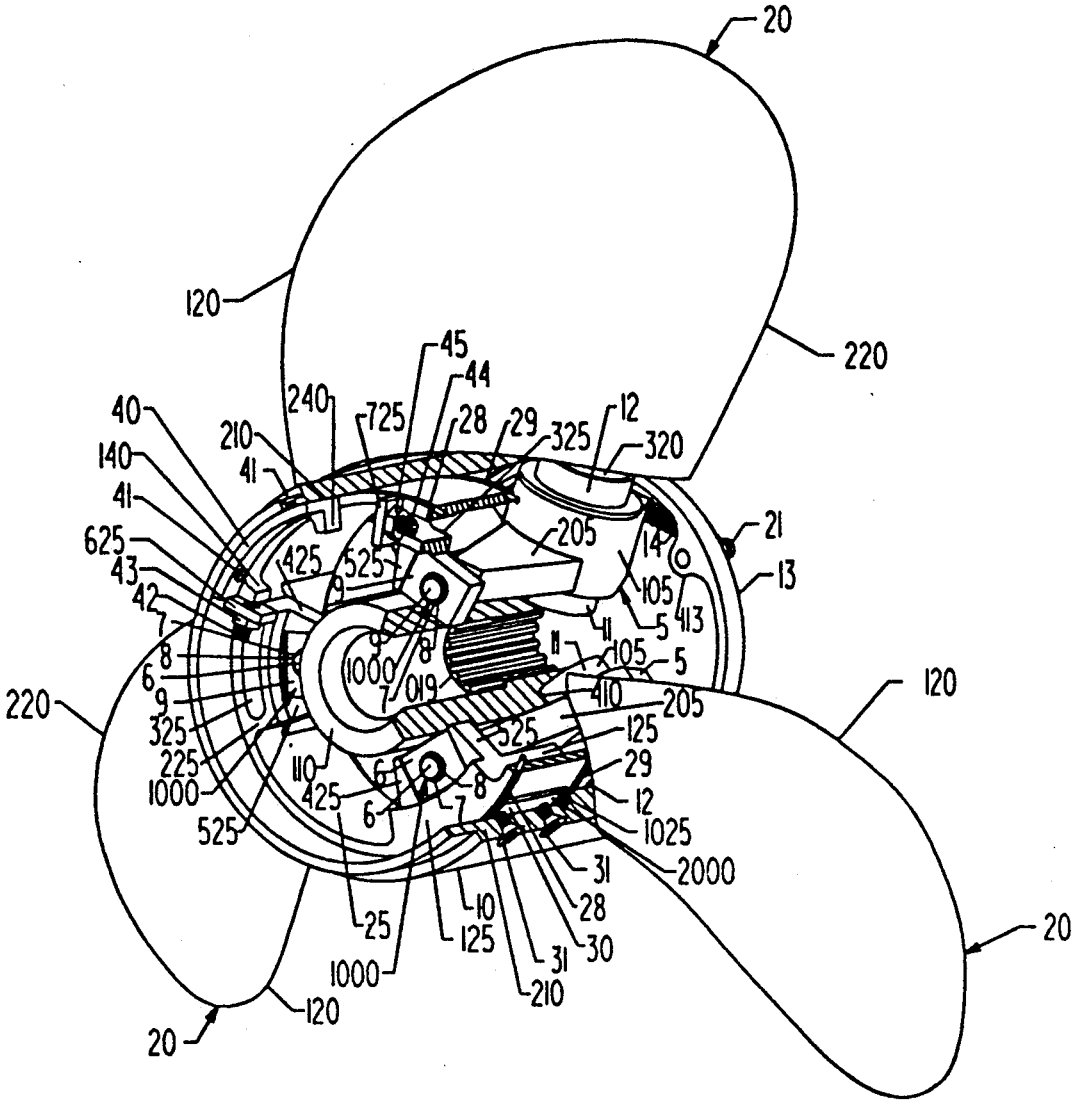
FIG. 7 is the same embodiment and view as FIG. 6, in the high pitch position.

When engine power is reduced from the cruising range, by a certain value, the force effect of the springs 14 in combination with blade inertial torque reactions, are sufficient to overcome the hydrodynamic forces on the blades 20 plus internal friction, thereby causing the blades 20 and coordinating ring 25 to rotate back toward the low pitch limit position. As the coordinating ring 25 rotates, the viscous fluid is forced from cavity 1025*a* through orifice 130 and into cavity 1025*b*. Thus, the vane orifice 130 shown in FIGS. 6 and 10 provides substantially the same damping characteristics for either direction of pitch change.

It should be noted that upon a rapid deceleration in engine power and boat speed, the hydrodynamic loads, acting on the blade are reversed, and the hydrodynamic loads then act together with the spring force tending to move the blades back towards the low pitch limited position.

Figure 10:
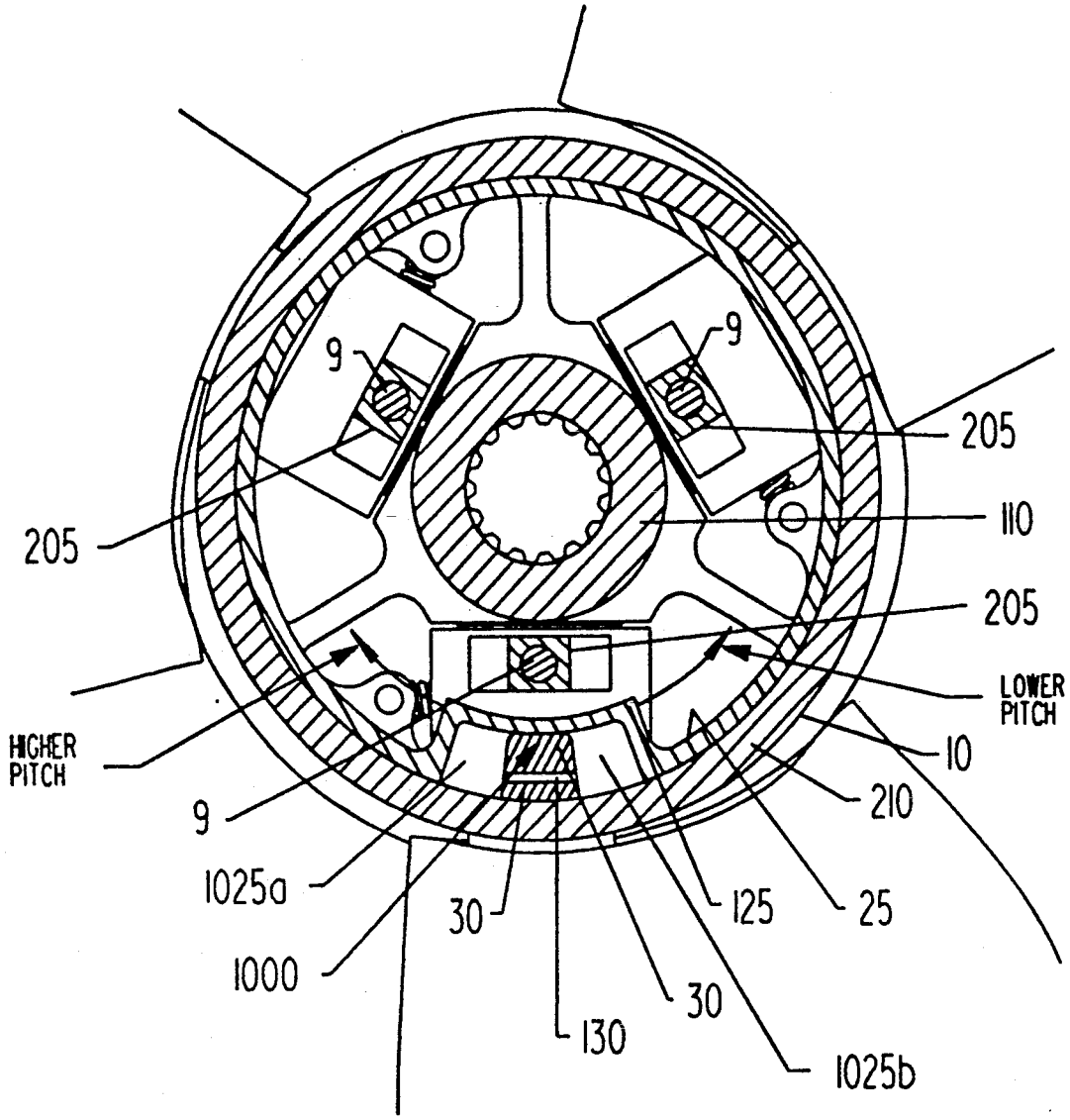
FIG. 10 is a section view, taken along lines 10—10 of FIG. 1 showing a vane/coordinating ring damper assembly having a single fixed orifice with the propeller components located in an intermediate position between the low and high pitch limited positions of FIGS. 2 and 3.

As mentioned, the damping provided for the embodiment shown in FIGS. 2 through 9 by the damping means of FIG. 10 is substantially the same for either direction of rotation, i.e., towards a higher angle of pitch or towards a lower angle of pitch. As this is not always desirable, a further improvement in the operation of this invention can be provided by incorporating automatic adjustment means for the damping of the system.

Such adjustment means can be designed to automatically vary the damping effect in response to changes in such operational parameters as the direction of the pitch change, pitch position of the blades, propeller rotational speed (RPM), boat speed (water speed), or blade hydrodynamic loading. Also, means allowing for manual adjustment of the level of damping can also be incorporated, directly or indirectly by modifying the effect on damping of the viscous operational parameters, to facilitate optimum performance of the propeller for each boat's operational characteristics. FIGS. 11 through 16 show alternative design details for damping system also useful for the devices shown generally in FIGS. 2 through 9, which provide for automatically variable and/or manually variable damping effects.

Figure 11:
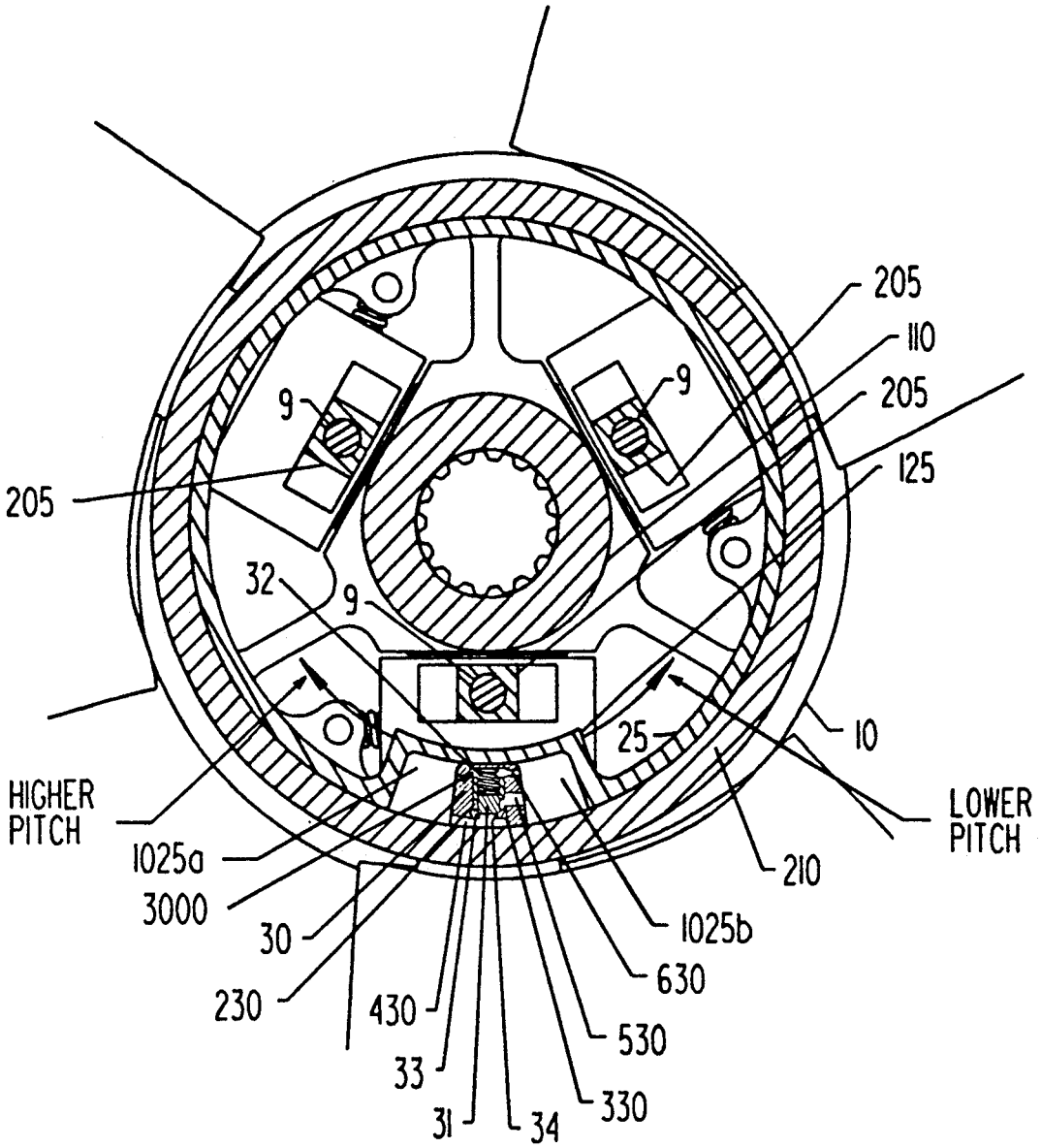
FIG. 11 is a section view, taken along lines 11—11 of FIG. 1 showing a second type of damper assembly in the vane/coordinating ring, having a low pitch return notion flow check valve 3000 with the propeller component located in an intermediate position.

The damping device shown in FIG. 11 includes a flow control valve, generally indicated by the numeral 3000, to control the viscous fluid flow between the two fluid-containing cavities, 1025*a,b*. The control valve 3000, is located within the vane 30, e.g., axially disposed relative to the channel 130, and controls a fluid by-pass around the orifice 130, for increasing fluid flow in one direction only, i.e., from cavity 1025*a* into cavity 1025*b;* this reduces the damping effect in that direction, and thus permits a faster return of the propeller blades 20 from the high position to the low pitch limit position. The mechanism of the flow control valve 3000 fits within a cylindrical cavity 230 formed in the body of vane 30, and includes a spring 32 and a piston 31, and an annular valve seat 33; the spring 32 biases the head of the piston 31 against the seat 33; a fluid seal is formed when the angled corner surfaces of the piston head 31 contact the annular seat 33. The piston 31 is slidably held within the cylindrical cavity 230; the seat 33 is press-fitted into the radially outward end of the cylindrical cavity 330. A flow channel 430 is provided in the vane body 30 connecting the coordinating cavity 1025*a* to the valve seat inlet 34; two flow channels 530 and 630 connect the valve cylinder cavity 230, with the second coordinating ring fluid cavity 1025*b;* the outlet channel 530 connects through the other side of the valve seat 33, and the flow channel 630 exposes the rear of the piston 31 to fluid in a cavity 1025*b*.

The flow control valve 3000 thus acts as a check valve, allowing flow through the secondary damping channel 430, 530 only during movement towards a lower pitch, opening up to increase the fluid flow when the blades ate moving towards the low pitch limited position. The operation of the by-pass valve 3000 is as follows: When the propeller blades 20 and coordinating ring 25 are caused to rotate from a lower to a higher blade pitch position, an increased fluid pressure differential is generated between the fluid cavity 1025*a* and the second cavity 1025*b* as a consequence of the flow impedance provided by orifice 130. This higher relative fluid pressure in combination with the biasing force of valve spring 32 tends to push the control valve piston 31 against seat 33, thereby preventing flow of the viscous fluid through the by-pass of the flow control valve 3000.

Conversely, when the propeller blades 20 and coordinating ring 25 are caused to rotate from a higher to a lower blade pitch position, a relatively higher fluid pressure is generated in the second cavity 1025*a*, such that this differential pressure acts on the piston 31 in opposition to the bias force of the valve spring 32; at a sufficient fluid differential pressure, the piston head 31 is moved away from the valve seat 33, permitting viscous fluid through the by-pass channel, from the first ring cavity 1025*a*, through the channel 430, through the check valve seat 33 and through the second channel 530 into the second ring cavity 1025*b*, thus permitting faster movement of the blade towards the lower pitch by increasing viscous fluid flow.

The placement of the valve piston 31 as shown in FIG. 11, is such that its axial longitudinal movement is radial relative to the propeller drive shaft axis X, and thus that the rotational inertial forces acting on the piston 31, during propeller rotation, tend to bias the piston 31 against seat 33. This arrangement has the advantage of providing a centrifugal biasing force acting with the spring biasing force imposed on check valve piston 31 towards the closed position, hence maintaining a higher level of damping when the propeller is rotating at a higher RPM. With this arrangement, if the engine power is suddenly reduced during normal cruise speed operation, the opening of the flow control valve 3000 is further restrained by the centrifugal force affect until a significant reduction in propeller speed has also occurred, thereby reducing the possibility of engine overspeed once engine power is reapplied, or reducing the level of boat deceleration, or drag, imposed by the propeller when power is suddenly reduced.

Figure 12:
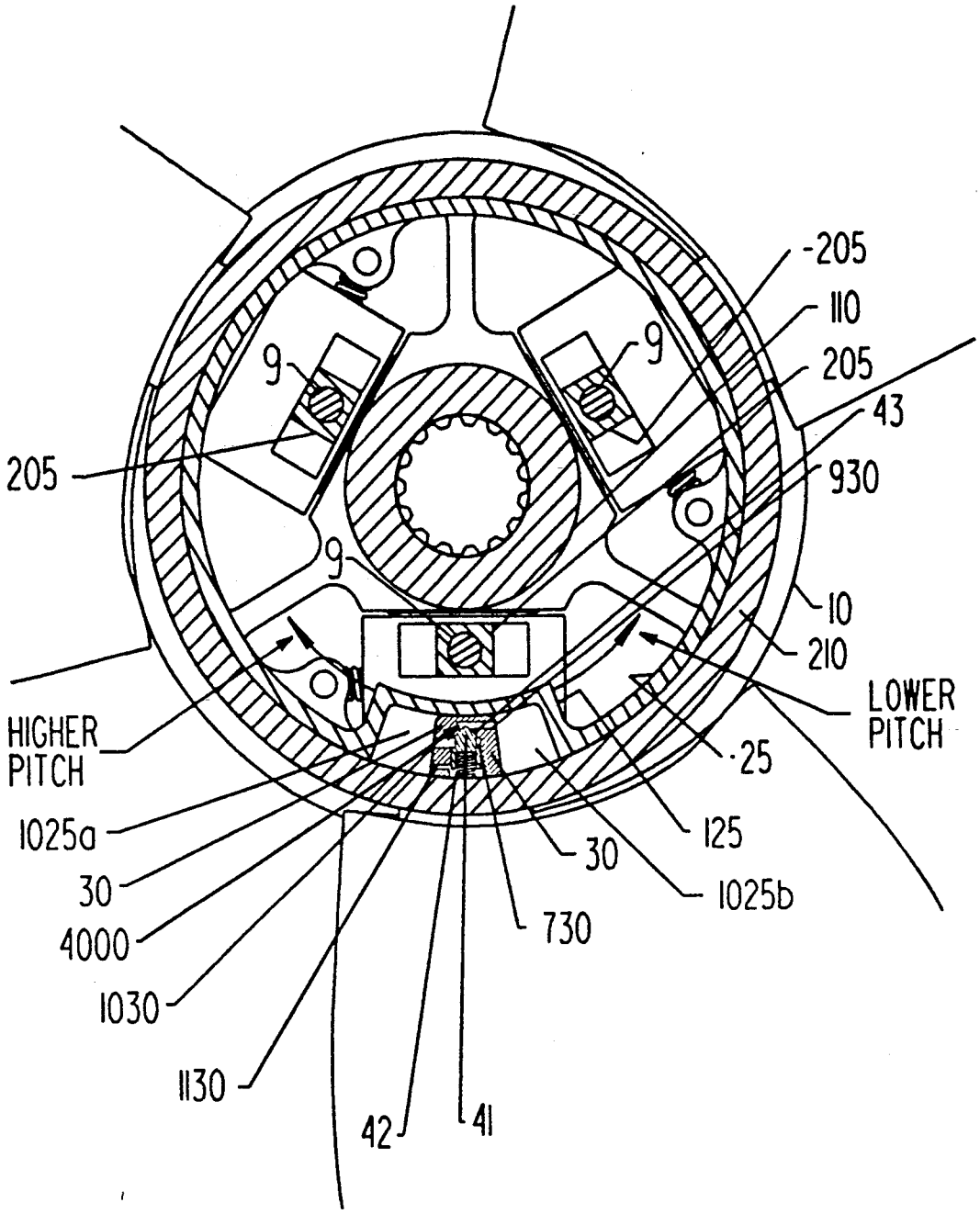
FIG. 12 is a section view taken along lines 12—12 of FIG. 1 showing a third type damper assembly in the vane/coordinating ring, used in combination with the damper assembly of FIG. 11 or of FIG. 10, and having a high pitch advance motion pressure relief valve 4000 with the propeller components located in an intermediate position.
Figure 13:
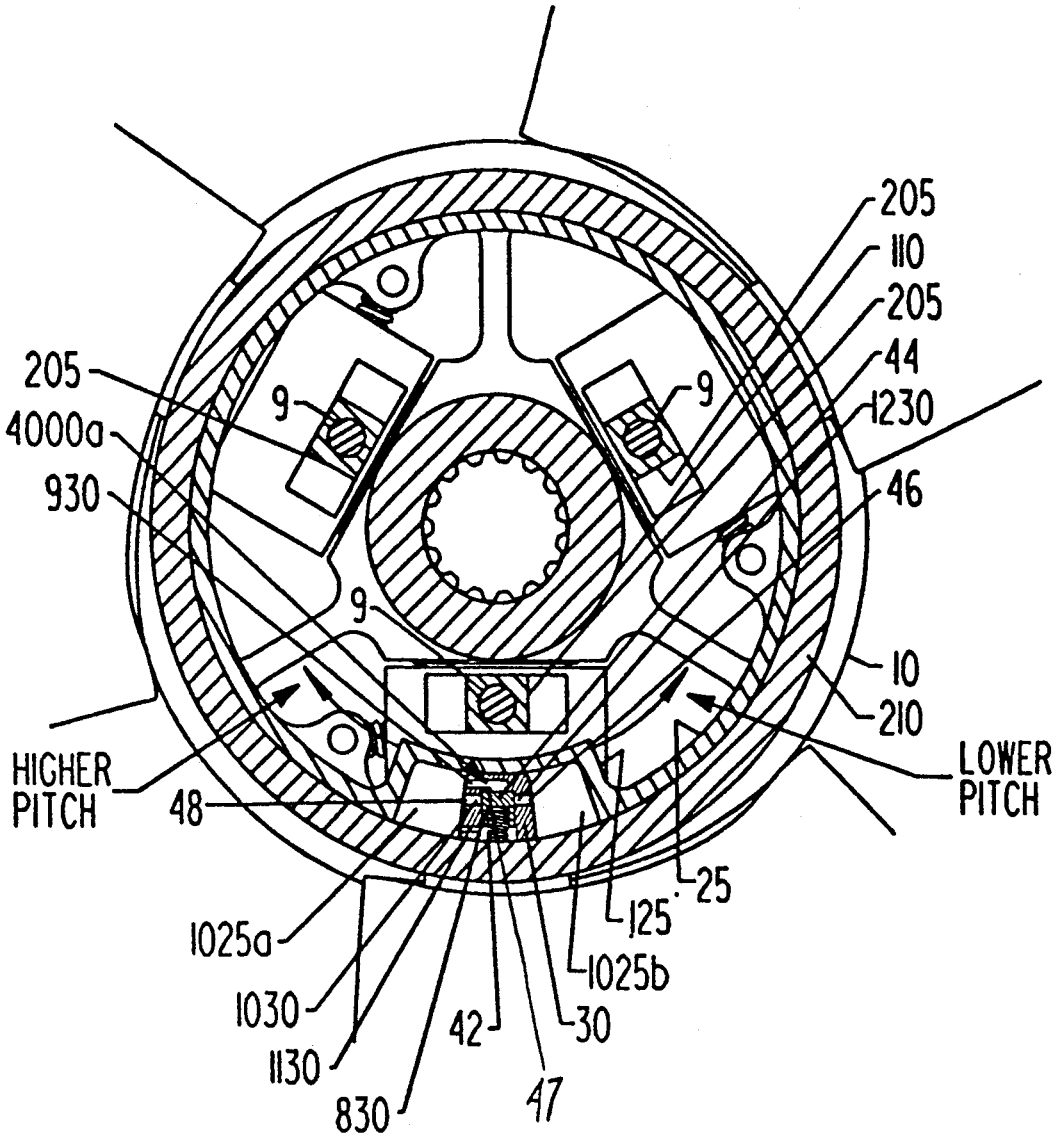
FIG. 13 is a section view taken along lines 13—13 of FIG. 1 showing another type of damper assembly in the vane/coordinating ring, and useful in combination with the damper assembly of FIG. 11 or FIG. 10, and having an automatic high pitch advance motion rate-of-change control valve 4000*a* with the propeller components located in an intermediate position.
Figure 14:
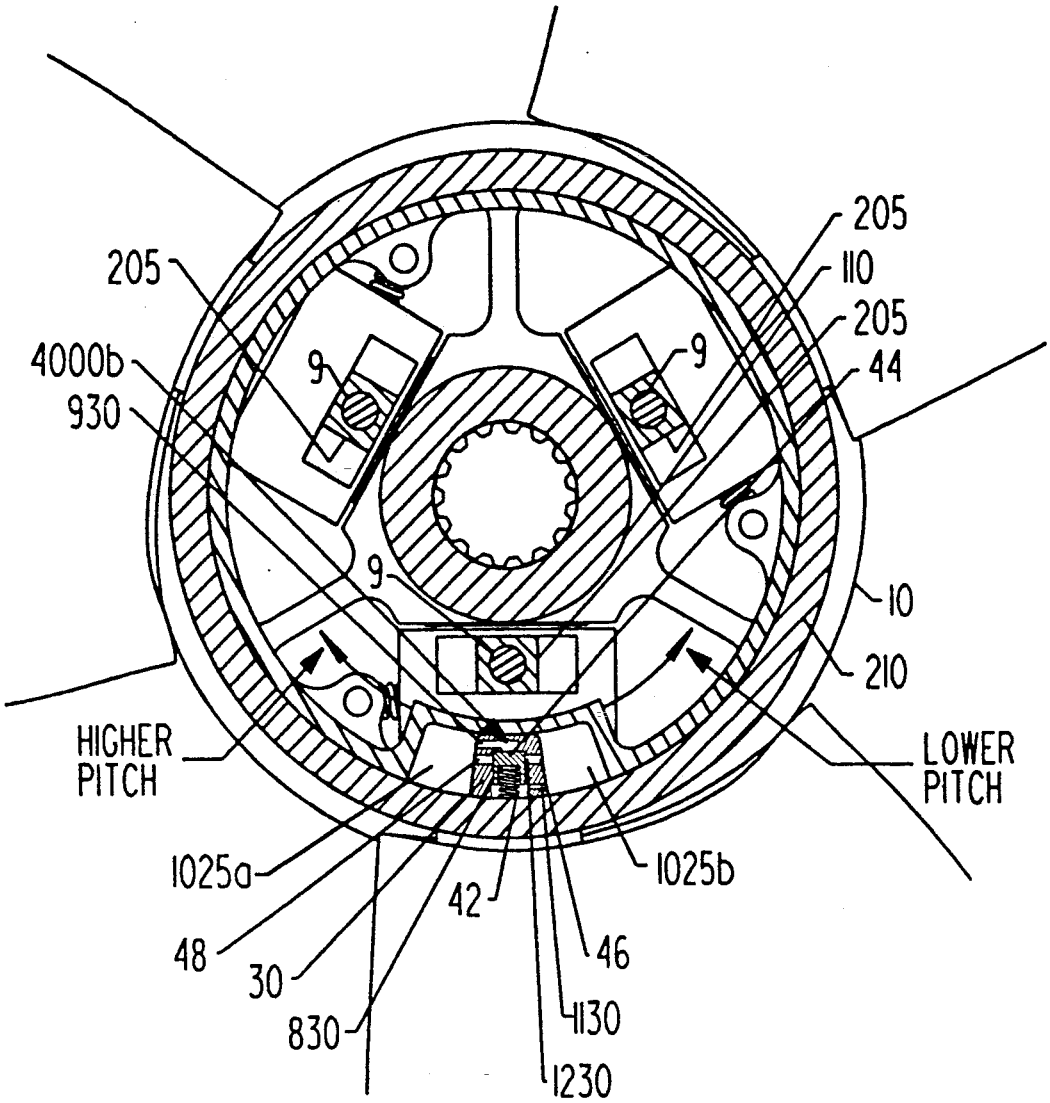
FIG. 14 is an axial section view taken along lines 14—14 of FIG. 1, showing a fourth type of modified damper assembly in the vane/coordinating ring, also useful in combination with the damper assembly of FIGS. 10 or 11, and having an automatic high pitch advance motion rate-of-change control valve 4000*b* incorporating hydrodynamic loading feedback means, with the propeller components located in an intermediate position.

Additional alternate flow control valve configurations generally indicated by the numeral 4000, are shown in FIGS. 12 through 14. These flow control valves 4000 are designed to vary the flow restriction, and hence the level of damping, when the blades 20 and the internal mechanism are tending to move toward a higher blade pitch angle position. As is further described below, the type of valve design of the control valve 4000, can be configured to function as a single check valve, as a pressure relief valve, or as a flow control valve capable of preventing the flow of viscous fluid and, hence, reducing the speed of rotation or retaining the blades in position, depending upon whether this is combined with a permanently open channel, as in FIG. 10, or another valve as in FIG. 11.

An arrangement wherein the flow control valve 4000 can function as either a check valve or as a pressure relief valve is shown in FIG. 12.

Into a cylindrical cavity 730 defined within the body of the sliding vane 30, are positioned a spring 42 and a piston 41, which is biased by the spring 42 against a valve seat 43; a fluid seal is provided by the contacting of the head of the piston 41 against the valve seat 43. A first channel 930 connects the vane body cavity 730 with the low pitch coordinating ring cavity 1025*b*; two flow channels 1030, 1130 connect the vane body cavity 730 with the high pitch coordinating ring cavity 1025*a*.

If the spring 42 biasing force preload acting on the piston 41 is relatively low, the valve 4000 acts as a check valve to reduce the flow restriction and, hence, allows for a more rapid transition from a lower to a higher blade pitch position, than in the reverse direction. If the spring 42 biasing force preload is much greater, the valve 4000 can be made to act as a pressure relief valve thereby allowing for a more rapid advance toward higher pitch only when the twisting moment about the blade shaft axis Y exceeds a specified value, determined by the spring moment or hydrodynamic loads.

The operation of valve 4000 is as follows: When the propeller blades 20 are in a higher pitch position, and the hydrodynamic forces on the blades tend to cause them to rotate to a lower blade pitch position, a higher fluid pressure is generated in cavity 1025*a* than in cavity 1025*b*, as a consequence of the flow impedance provided by the vane orifice 130. This higher fluid pressure, in combination with the biasing force of the valve spring 42, tends to push the control valve piston 41 against seat 43, thereby preventing flow of the viscous fluid through the flow control valve 4000, and all flow between the two cavities 1025*a,b*, can only go through the vane orifice 130.

Conversely, when the propeller blades 20 and coordinating ring 25 are in a lower pitch position, and operating forces tend to cause them to rotate to a higher blade pitch position, a higher fluid pressure is generated in cavity 1025*b*, than in cavity 1025*a*, such that this differential pressure acts on the piston 41 to compress the valve spring 42, and to displace the piston 41 from the seat 43. If sufficient fluid differential pressure is generated, the control valve 4000 is opened, and the viscous fluid allowed to flow from the coordinating ring cavity 1025*b* into the channel 930, through both the vane orifice 130 and the check valve channel 1030 and into the coordinating ring cavity 1025*a*. As the piston 41 is displaced, fluid behind the piston 41 is allowed to drain out of the cavity 730, through the channel 1130 and into cavity 1025*a*.

It should be noted that the valve piston shown in FIG. 12 is also permitted to slide radially relative to the propeller drive shaft axis X, such that rotational inertial forces acting on the piston 41, tend to bias the piston 41 away from the seat 43. This arrangement has the advantage of providing a centrifugal biasing force additionally opposing the spring biasing force acting on the check valve piston 41.

As the centrifugal loads acting on the piston 41 tends to bias the valve toward the open position, once the propeller RPM has increased to generate sufficient centrifugal force on the piston 41 and displace the spring 42, a reduction in fluid impedance occurs as the valve opens. This allows for a more rapid advancement from a lower blade pitch position to a higher blade pitch position under higher propeller RPM conditions.

An alternate design for the control valve 4000*a*, also providing a centrifugal force effect-activated hydraulic locking, or holding, means is shown in FIG. 13. This control valve 4000*a* prevents fluid flowing from coordinating ring cavity 1025*b* to cavity 1025*a*, until a sufficient propeller rotational speed RPM has been achieved; upon reaching the specified rotational speed, the centrifugal force effect on the piston spool 44, in opposition to the spring force 42, causes the control valve 4000*a* to open, and to allow the blades 20 and the internal propeller mechanism to advance toward a higher angle of pitch position. The operation of the control valve 4000*a* shown in FIG. 13 is as follows: when the propeller is at rest or at a low rotational speed, the valve spool 44 is biased in contact with the valve seat 47 (by spring 42), blocking the port 46. The porting geometry shown in FIG. 13 is arranged such that any differential pressure generated between the two coordinating ring cavities 1025*a,b* as a consequence of e.g. hydrodynamic torques applied about the propeller blade axis Y, does not result in any significant biasing force component along the spool axis of motion. Once the propeller rotational speed RPM has increased sufficiently, such that the centrifugal force effects acting on the spool mass are greater than the opposing spring 42 biasing force, the valve spool 44 slides radially outwardly within the cylindrical cavity 830, thus opening the port 46. As the valve spool 44 is displaced radially outwardly, any fluid behind the valve spool 44 is allowed to drain out of the cavity 830 through the channel 1130 into the ring cavity 1025*a*. The opening of the valve 4000*a* allows the coordinating ring 25, the blade positioning mechanism and the blades 20 to rotate to a higher blade pitch position.

FIG. 14 shows another modified porting geometry, which provides feed-back means to the operation of the spool valve 4000*b* responsive to the torque generated by, e.g., hydrodynamic forces acting to rotate the blades 20. In this arrangement, any rotation of the coordinating ring 25 towards the higher pitch position results in an increased pressure behind the valve spool 44, conveyed through the drain channel 1130 connection to the cavity 1025*b*, adding to the bias force of the spring 42. As a result, an increased centrifugal force effect, i.e., requiring a higher propeller RPM, is needed to generate sufficient centrifugal force on the valve spool 44, before the valve 4000*b* opens, and thereby releasing the blades 20 to move to a higher angle of pitch. Thus, a higher propeller RPM is required to move the blades rapidly to a higher pitch position under high acceleration conditions, than is required for low acceleration conditions, because under high acceleration, a greater hydrodynamic twisting movement is applied about the blade shaft axis Y, resulting in a greater differential pressure between coordinating ring cavities 1025*b* and 1025*a*, and thus in a higher biasing force on the valve spool 44, tending to keep the spool in a closed position.

It should be mentioned that this hydraulic locking effect, with or without hydrodynamic loading feedback (as in FIG. 14), provides a similar operational effect to the mechanical locking means presented in U.S. Pat. No. 4,929,153.

Figure 15:
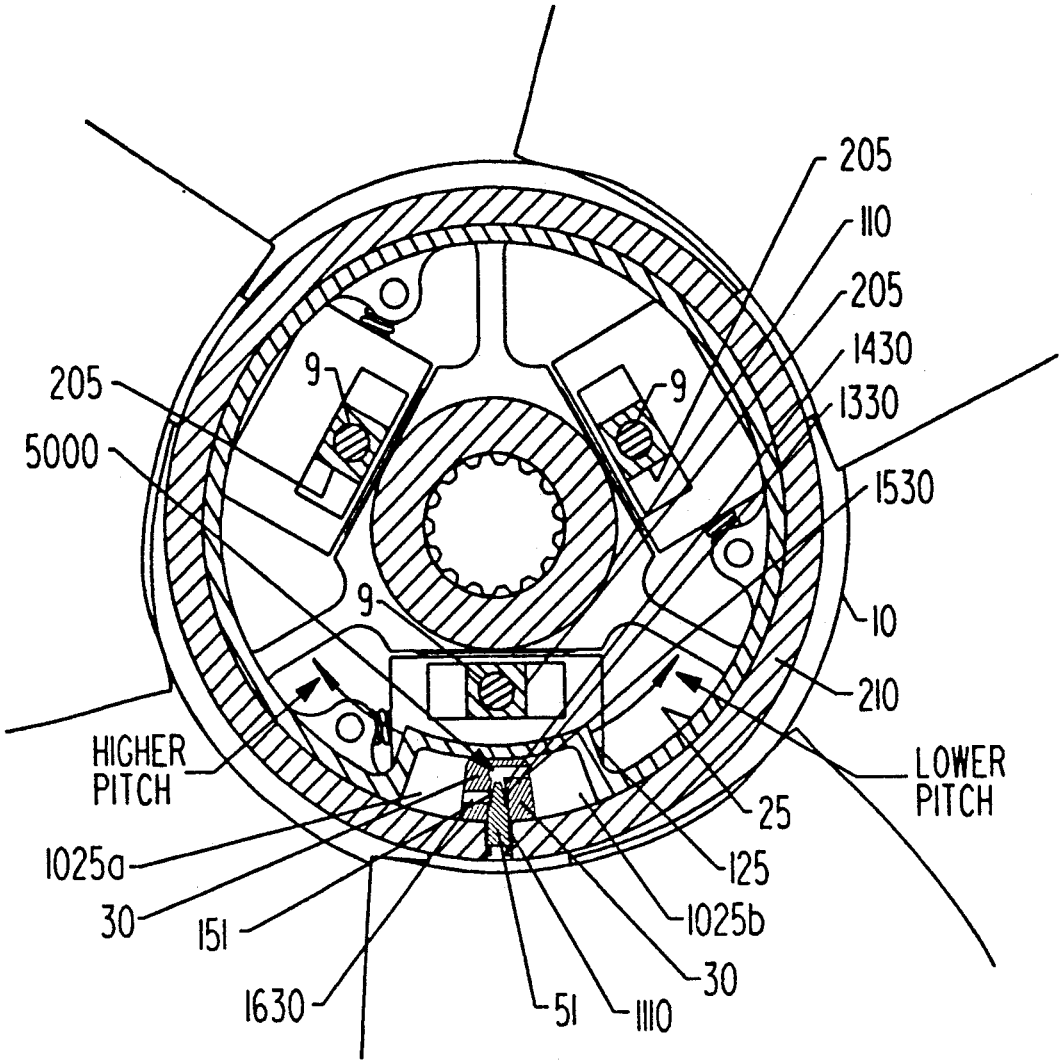
FIG. 15 is an axial section view taken along lines 15—15 of FIG. 1 showing a manually variable damper assembly in the vane/coordinating ring, and having a manual high pitch advance motion rate-of-change control valve 5000 with the propeller components located in an intermediate position.
Figure 15A:
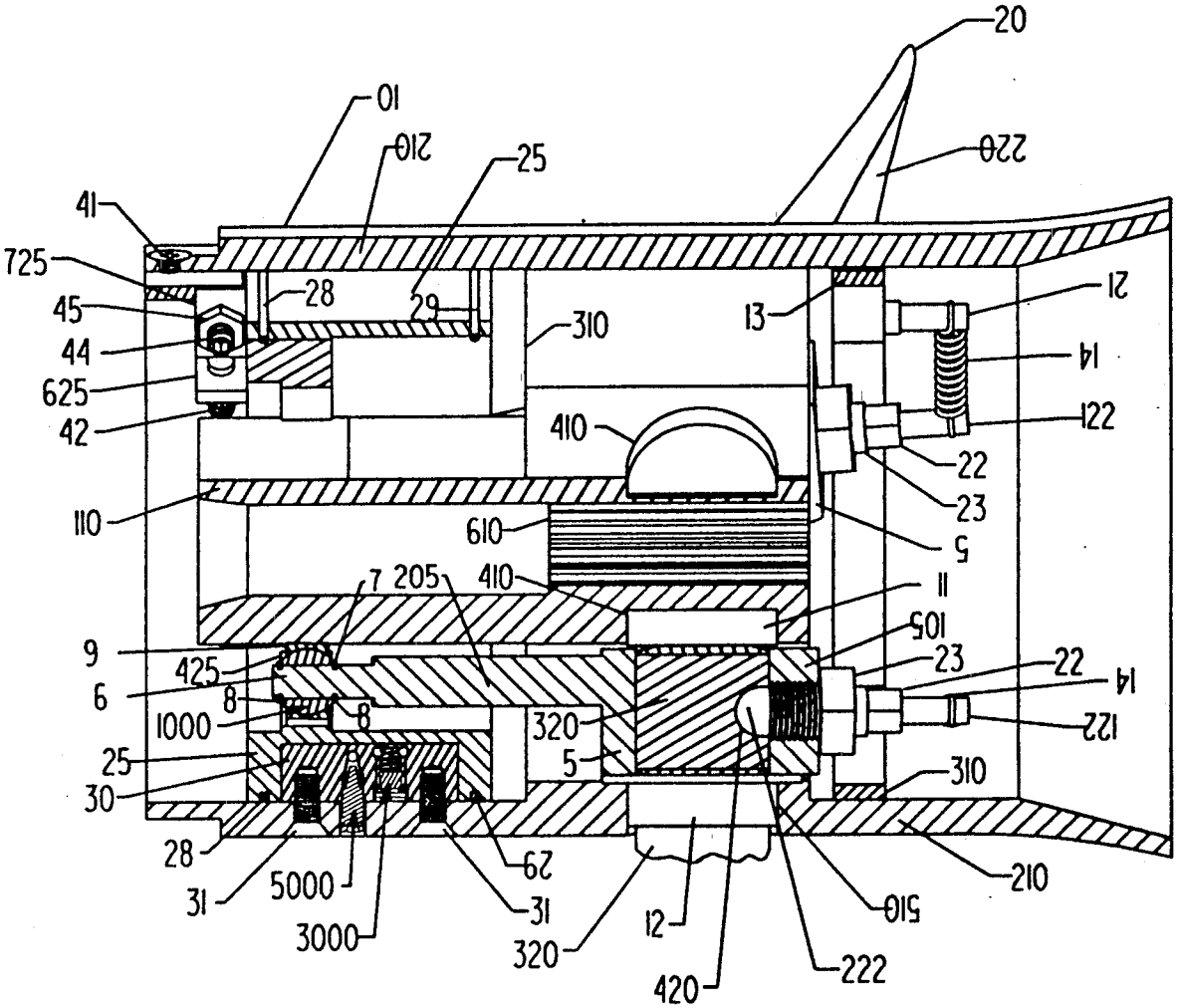
FIG. 15A is a longitudinal sectional view taken along lines 16A—16A of FIG. 2, showing a combined damper assembly in the vane/coordinating ring, in the low pitch operational position.

Manual means for adjusting the amount of damping, without respect to the direction of movement, can also be provided to allow the operational characteristics of the propeller to be optimized for specific boat or operating conditions. A manually adjustable valve, generally indicated by the numeral 5000, is shown in FIG. 15, and can be directly substituted for the permanent flow channel of FIG. 10. This valve arrangement shows a threaded needle valve screw 51, which is easily accessible from the exterior of the propeller hub case 210, and does not require that the propeller be removed from the drive shaft before making the manual adjustment.

The manual adjusting valve 5000 shown in FIG. 15 is incorporated into the body of vane 30 with external access to the valve adjustment screw 51 provided by a cylindrical hole formed in the outer hub case 210. The valve adjustment screw is inserted into an internally threaded cavity surface 1330 formed in the vane body 30. A tapered seat 1430 is located at the radially inward end of the cavity surface 1330. The tapered seat 1430 acts in combination with the tapered end surface 151 on the valve adjustment screw 51, to provide a variable area aperture as the adjustment screw 51 is manually moved radially into (or out of) the vane 30. The two channels, 1530, 1630 provide a fluid passage between the radially inward end of the valve area 1430 and the two coordinating ring cavities 1025*a,b*.

In operation of the manually adjustable valve 5000, moving the manual adjustment screw 51 radially inward, reduces the flow channel, thereby increasing fluid flow impedance and thus increasing the level of viscous damping For similar operational conditions this, in turn, reduces the rotational velocity of the propeller blade mechanism between various blade pitch positions. Conversely, turning the manual adjusting screw radially outward, increases the flow area defined by the valve screw 51, thereby decreasing the fluid flow impedance and, hence, decreasing the amount of viscous damping. For similar operational conditions, a reduction in viscous damping increases the pitch changing rotational velocity of the propeller blade mechanism during the transition between various blade pitch positions.

FIG. 16*a* shows a vane with two viscous flow channels, axially juxtaposed one to the other, one channel being the manually adjustable, but permanently open system of FIG. 15, and the second being the check valve 3000 shown in FIG. 11, in enlarged detail.

Figure 16:
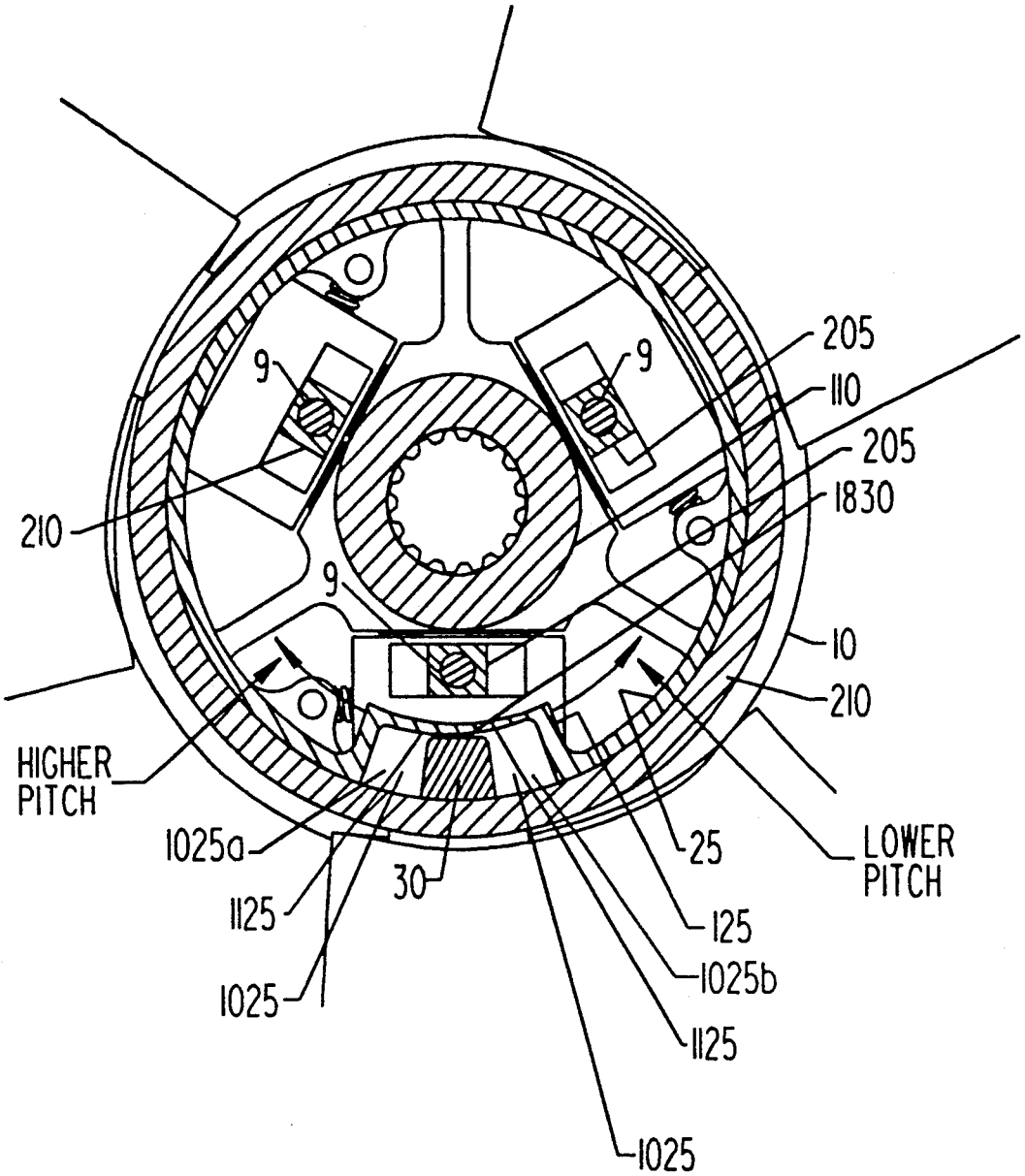
FIG. 16 is an axial section view taken along lines 16—16 of FIG. 1 showing the vane/coordinating ring damper assembly wherein the amount of damping is varied depending on the position of the coordinating ring, with the propeller components in an intermediate position between the low and high pitch limited positions.

The device shown in FIG. 16, is exemplary of damping means in which the level of damping varies as a function of blade pitch position. Here, the clearance between the radially inward surface 1830 of the vane 30, and the radially outward facing interior surface 1125, of the coordinating cavity 125 varies with changes in the circumferential position of the coordinating ring 25. This can be accomplished by forming the radially inward surface 1125 of the coordinating ring cavity 1025 such that it is no longer a cylindrical surface concentric with the radial coordinating ring 25 (as shown); or the top surface 1830 of the vane 30 is not concentric. As shown in FIG. 16, the distance between high pitch end of the interior surface 1125 to the vane surface 1830 is greater then the distance between the low pitch end of the interior surface 1125*b* and the vane surface 1830, and thus decreases the level of damping as the propeller blades are caused to move from the low pitch limited position to the high pitch limited position.

The preferred embodiment of this invention, as shown in FIGS. 2 through 9, and 10 through 16, utilize controlled viscous damping in combination with a hydrodynamic biasing moment, tending toward a higher blade pitch position, and a spring force biasing moment, tending toward a lower blade pitch position. Other alternative or additional sources for the primary biasing force means tending to rotate the blades 20 in one or the other direction, include biasing means derived from the centrifugal force effect, and/or biasing means derived from the propeller drive shaft torque. FIGS. 17 through 20 show an embodiment of this invention wherein a controlled damping means is combined with blade pitch position biasing means derived from the propeller drive shaft torque.

Figure 17:
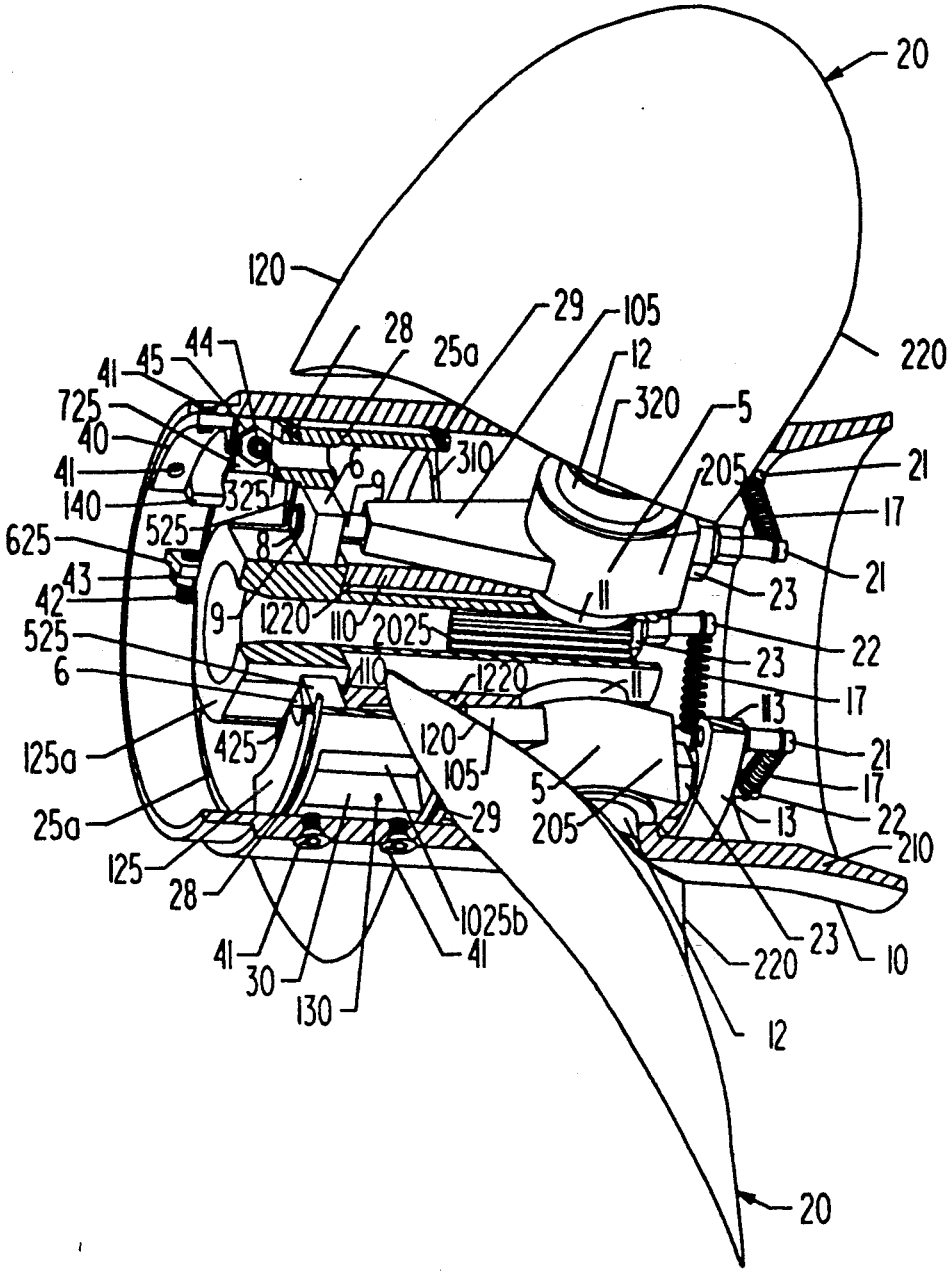
FIG. 17 is a sectional isometric view of a second continuously variable pitch embodiment of the propeller assembly having a propulsion drive torque-biased rotating coordinating ring, with the internal mechanism and blades located in the low pitch limited position.
Figure 18:
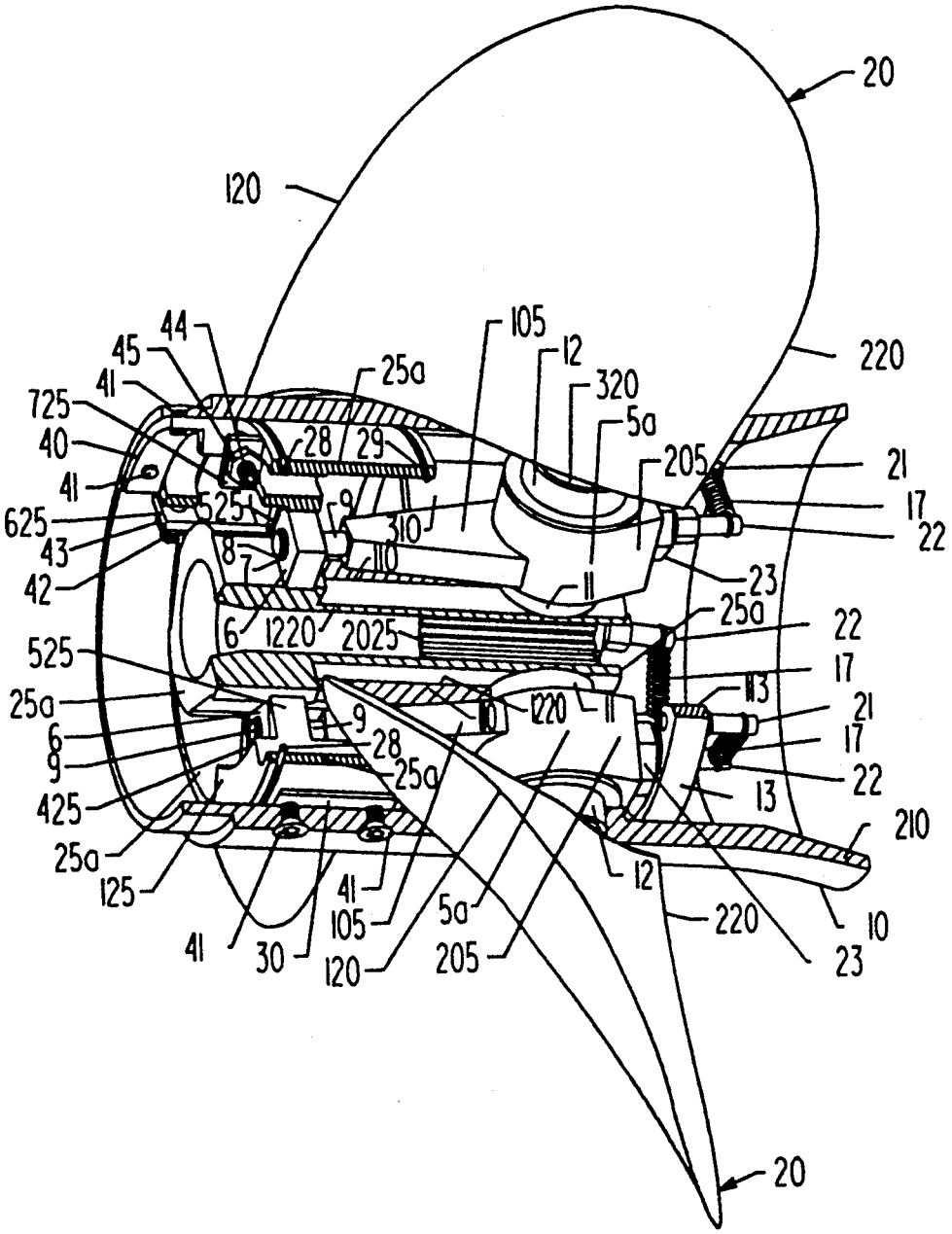
FIG. 18 is the sectional isometric view of the propeller of FIG. 17, with the internal mechanism and blades located in the high pitch limited position.

In the embodiment shown in FIGS. 17 and 18, a shortened internal hub cylinder 110 is fixedly held by the web 310 within the hub case 10. Axially and rotatably slidably held within, and substantially concentric with the internal hub cylinder 110 is a spline drive 1220 having internal splines 2025, formed as an integral unit with an interior coordinating ring member 125*a*, which in turn is affixed to a modified outer coordinating ring 25*a* by ring webs 425 and 525. In this arrangement of FIGS. 17–20, the drive shaft torque is thus transmitted from the spline drive connection to the coordinating ring member 25*a* through the interior ring member 125*a*. The drive shaft torque acts as a biasing torque on the coordinating ring member 25*a* tending to position it towards the low pitch limit position.

In general, the embodiment of FIGS. 17–18 is a modification of the device of FIGS. 2–9, wherein to compensate for the drive torque bias, the coil springs are repositioned to bias the blades towards the high pitch position. To accomplish this modification the spring retainer ring 13 is set at a circumferential angular position such that the relative positions of the bias spring retainer pins 21,22 on the spring retainer arm 13 and the blade arm 5, respectively, reverses the spring force provided by the bias coil springs 14 in FIGS. 2–9, so as to produce a twisting moment about the blade shaft 320 biasing the blades toward a higher angle of pitch. Further, the spring constant of the high pitch biasing springs 17 used in this embodiment is preferably significantly greater than that of the low pitch bias springs 14 utilized for the embodiment shown in FIGS. 2 through 9. Also, the location of the blade shaft 320 is preferably not as far aft on the blade as that preferred for the embodiment shown in FIGS. 2 through 9; in this embodiment, it is preferred to reduce the maximum twisting moment towards the high pitch position generated about the blade shaft 320 by the hydrodynamic loads on the blade surfaces 20.

It is known that the hydrodynamic center of pressure of propeller blades can change during operation. It is even possible, by placing the shaft near the center of the blade, that the direction of the hydrodynamic torque can be reversed. Specifically, by placing the shaft, and thus the pivot axis of the blade, slightly towards the front on the blade, the hydrodynamic center of pressure is aft of the shaft during the initial hard acceleration of the propeller, thus producing a torque on the blade tending towards the lower pitch position, but at cruising speed, or when the acceleration is at a reduced level, the center of pressure moves to a position forward of the shaft, and thus create a torque on the blade tending towards the higher pitch position.

The operation of the embodiment shown in FIGS. 17 and 18 is as follows: with the engine and propeller at idle, i.e., at a low rotational speed (RPM), the biasing forces of the tension springs 17 are sufficient to position the blade arm 5, the blades 20 and the associated components, at the high pitch limit position, as shown in FIG. 18. Upon increasing engine power output, and thus increasing the propeller drive shaft torque, a point is reached when the drive shaft torque, as transmitted through the coordinating ring member 25*a*, is sufficient to move the coordinating ring member 25*a*, the blade arms 5 and the other connecting mechanisms and the blades 20 towards the low pitch limit position, overcoming the high pitch position biasing effect of the tension springs 17, and any hydrodynamic force components acting forward of the blade shaft axis Y. Upon the application of significant power, such as for full throttle acceleration, the engine torque is sufficient to move the blades into the low pitch limit position, completely overcoming the biasing effect of the spring 17 and any hydrodynamic components and friction.

When the boat has reached cruising speed, and engine power is reduced to maintain a constant speed; the spring constant is so designed to be sufficient to overcome the thus reduced propeller drive torque and together with the hydrodynamic effect of the blades, cause the blades and the other components to move towards a higher angle of pitch. The point at which equilibrium is reached between the drive shaft torque bias effect and the spring bias effect and any hydrodynamic effect, determines the operational pitch position of the blades. The damping effect of the viscous flow system within the coordinating ring 25*a* affects the rate-of-change in position of the blades, in the same manner as previously described.

Figure 19:
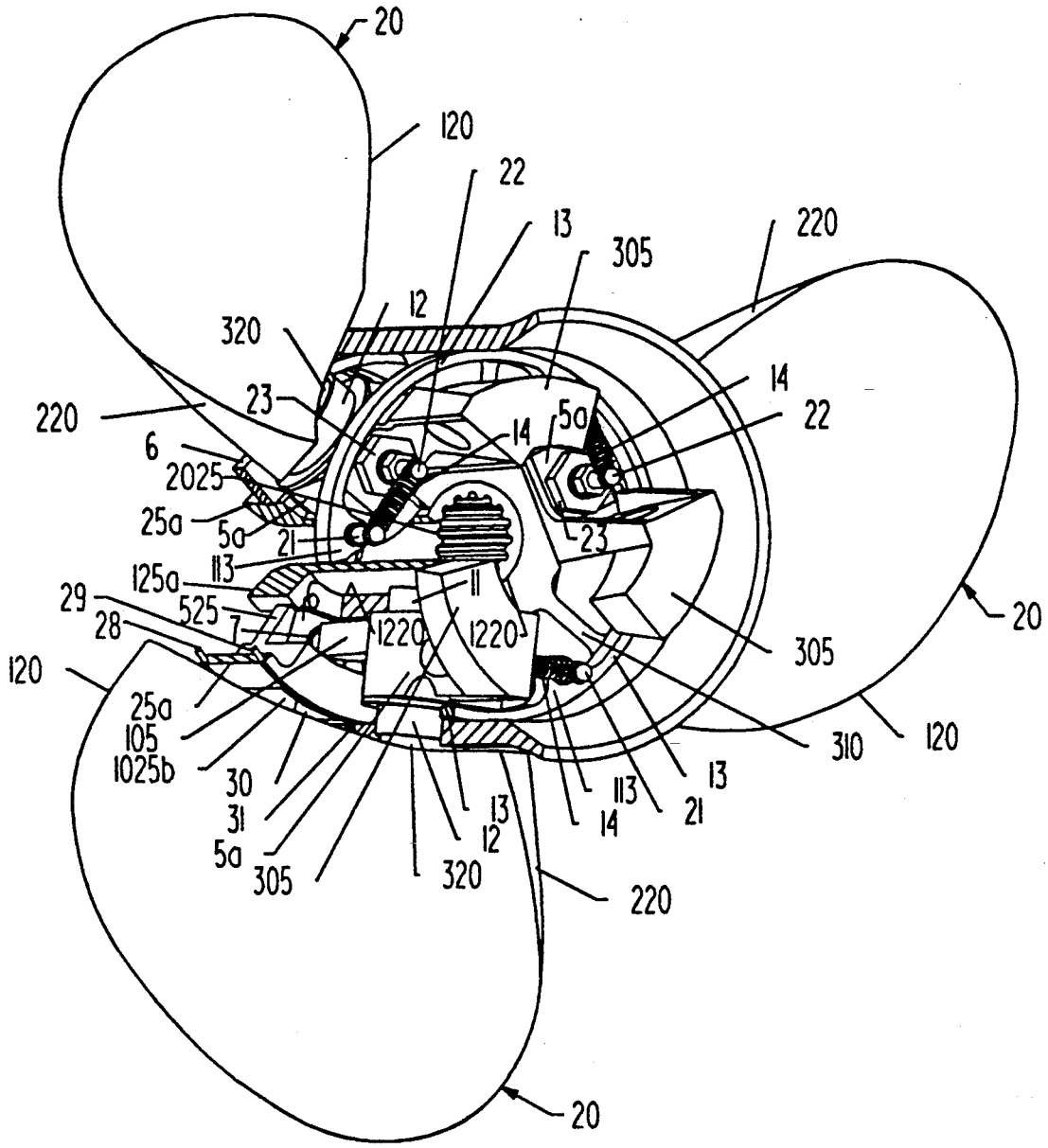
FIG. 19 is a further sectional isometric view of the second embodiment of the propeller assembly of FIG. 17, showing a counterweight biasing member attached to the blade arm, with the internal mechanism and blades positioned in the low pitch limited position.
Figure 20:
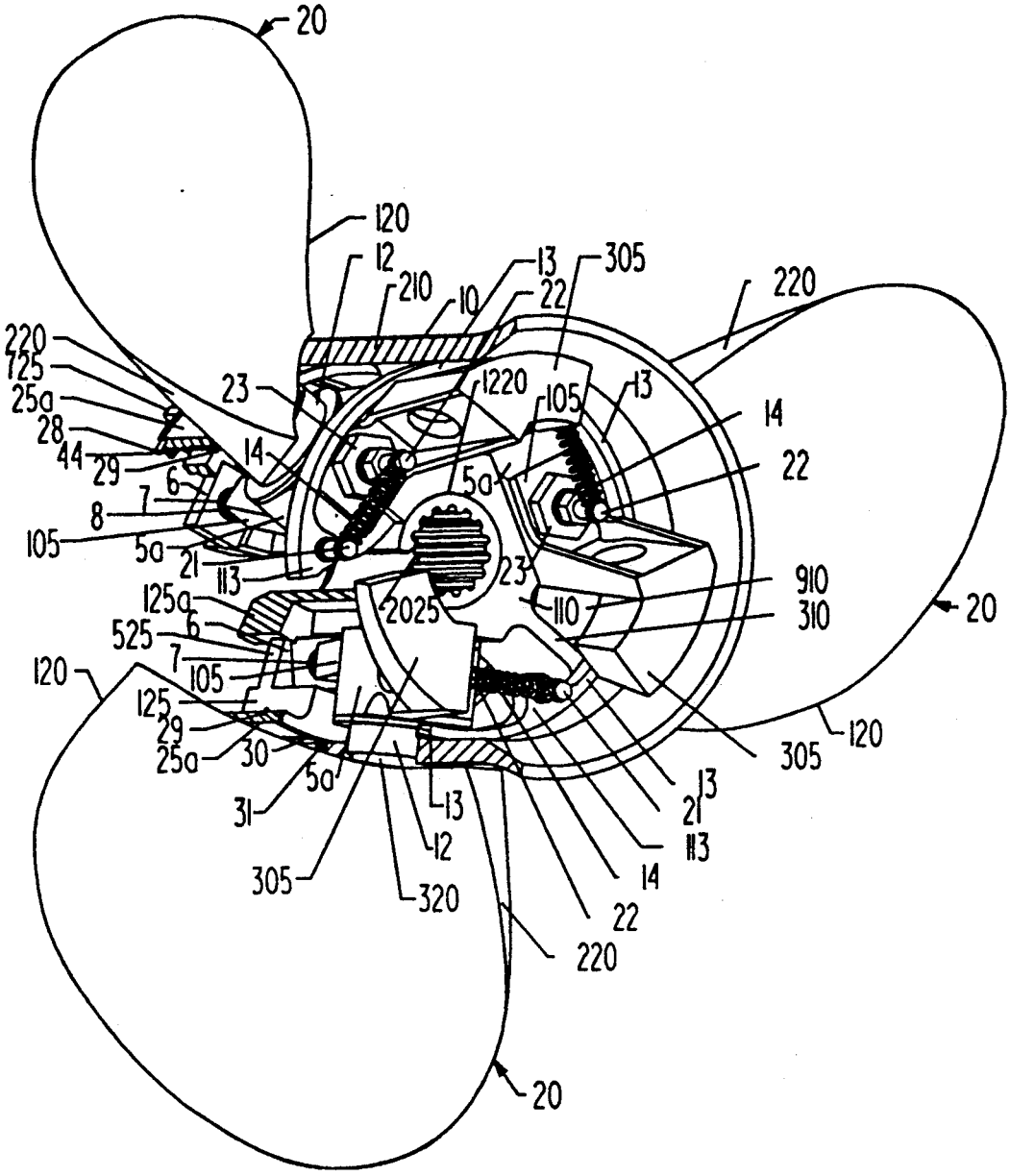
FIG. 20 is the sectional isometric view of the propeller of FIG. 19, with the internal mechanism and blades located in the high pitch limited position.
Figure 21B:
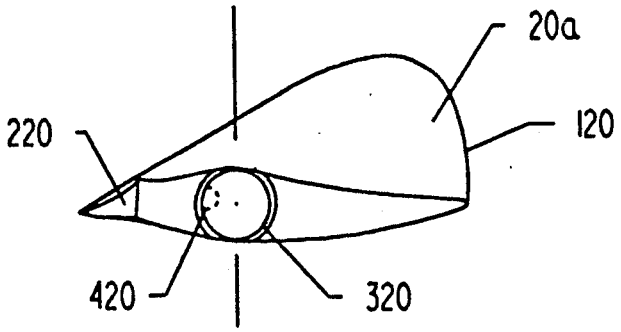
FIG. 21*b* is a top view of the propeller blade in FIG. 21*a*, looking radially outward along the blade shaft axis Y.
Figure 21A:
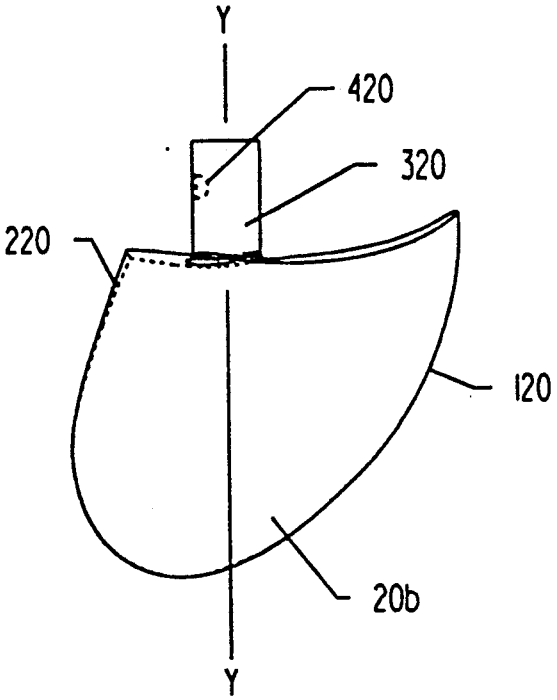
FIG. 21*a* is a side elevation view of a typical propeller blade used for some of the embodiments of FIGS. 2 through 20 wherein the shaft is located forward of the blade center of pressure.
Figure 21C:
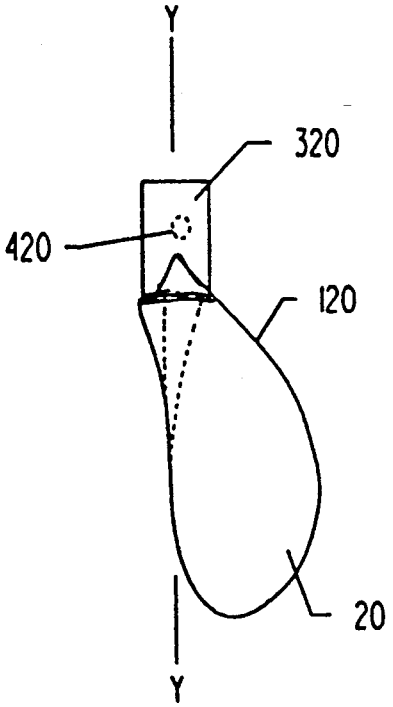
FIG. 21*c* is a rear view of the propeller blade in FIG. 21*a;*

A further improvement is shown in FIGS. 19 and 20, in which the blades are initially positioned in the low pitch limit position, to facilitate low boat speed maneuvering and acceleration when engine power is first applied. This embodiment includes additional mass means to provide a centrifugal force effect tending to move the blades and associated components toward a higher angle of pitch. The blade shaft 320 is located aft on the blade (as in FIGS. 22*a,b&c*) so as to provide an increased hydrodynamic bias toward a higher angle of pitch, and the spring retainer pins 21, 22 are so positioned that the force of the springs 14 can be acting in the same direction as that shown in FIGS. 2 through 9, and so as to bias the blades 20, towards the low pitch limit position.

As shown, a counterweight member 305 is rigidly attached to each blade arm 5*a*, such that the centrifugal forces acting on the counterweight member 305 create a twisting moment about the blade shaft axis Y tending to move the blades 20 and arm 5*a* assembly toward a higher blade pitch position. As this centrifugal force effect of the counterweight member 305, increases geometrically in magnitude, i.e., by the square of the propeller rotational speed RPM, given sufficient mass it will overcome the biasing effect of the drive shaft torque and the spring 14. Thus, varying the mass of the counterweight member, permits varying the desired RPM at which the centrifugal force torque exceeds the propeller drive torque, and thus permitting the blades to move to a higher angle of pitch, without having to manually reduce engine power.

The operation of the counterweight equipped alternate embodiment shown in FIG. 19 is as follows: with the engine and propeller at idle, or at a low rotational speed (RPM), the biasing force of the tension springs 14 position the counterweight arm 5*a*, the blades 20 and associated components, and the coordinating ring member 25*a*, at their low pitch limit positions, as in FIGS. 2–9. The drive shaft torque acts in the same direction as the springs 14. As the propeller rotational speed RPM is increased, the biasing component from the centrifugal force effect torque tending to move the blade 20 towards a higher angle of pitch, increases proportional to the square of the propeller's rotational speed RPM increase. At a specific propeller rotational speed, the net centrifugal force effect biasing torque in combination with any hydrodynamic biasing torque tends to move the blades 20 toward a higher angle of pitch, overcoming the low pitch directed spring force biasing effect created by the spring 14 and the drive torque biasing effect acting on the spline drive/coordinating ring member 25*a*. Balancing of the opposed biasing components about the blade shaft axis Y determines the operational pitch position of the blades 20 under any set of operating combinations. The effect of the damping system as shown, e.g., in FIGS. 10–16, in controlling the rate-of-change in angular pitch position of the blades follows the same operation as previously described, above, for the first embodiment shown in FIGS. 2 through 9.

It should be noted that the embodiment shown in FIGS. 19 and 20 has the operational advantage of allowing the blades to automatically be positioned at a higher blade pitch angle when engine power is reduced, after cruising speed is reached, and to automatically reposition the blades to a lower angle of pitch when high power is restored during acceleration. This allows the engine and propeller drive system to operate in a manner similar to an automobile automatic transmission.

In a third embodiment of this invention, a damping means is incorporated into a system which provides for an infinitely variable pitch position, and in which the pitch of the blade is caused to change by a combination of the hydrodynamic forces acting on the blades about the blade shaft axis, and the radially outward acting centrifugal or inertial, force effect acting directly on the mass of each propeller blade as is shown in FIGS. 23 through 30.

Referring to FIGS. 23–30, three annular cam sleeves 3 are inserted into and fixed to the hub, generally indicated by the numeral 1, through a bore 501 formed in the outer hub case 201 and into a mating pocket 401, in the inner hub 101; opposed cam groove slots 103 are formed through the cam sleeve. Also formed around the inner surface of the inner hub 101 are splines 601 which mate with the propeller drive shaft. The web members 301 rigidly connect the inner hub 101 to the outer hub case 201, and define longitudinal passages 901 through the hub, through which engine exhaust gasses can flow.

Each propeller blade, generally indicated by the numeral 2, comprises a blade shaft 302 extending radially inward from the blade hydrodynamic surfaces 102, through one of the cam sleeves 3. Each blade shaft 302 has a retainment hole 402 extending laterally through the blade shaft 302 and designed to mate with the cam groove slots 103. A pin 4 is inserted through the blade retainment hole 402 and the cam groove slots 103.

As in copending application Ser. No. 645,096, the blade shafts 302 are initially positioned radially inward, as in FIGS. 23, 25 and 27 and then are caused to be moved radially outward by the inertial centrifugal forces; the surfaces of the cam grooves 103 acting upon retainer pin 4 cause the blades to rotate, generally toward a higher angle of pitch as they move outwardly.

The combined blade motion, i.e., radial and rotary, can be helical as in U.S. Pat. Nos. 2,998,080 by Moore and 4,792,279 by Bergeron, or a modified helical movement, as in the above copending application, which results in a hold, or a restraint, on the blades in one or more defined angular pitch positions.

Each pin 4 also connects the sleeve 3 and each blade shaft 302, with a winged collar 56; the pin 4 passes through the mating bore holes on opposite sides of the collar 56; the pin connector, the collar 56 and the blade 2 thus become an integral assembly, moving both rotationally and radially as a single unit.

Figure 31:
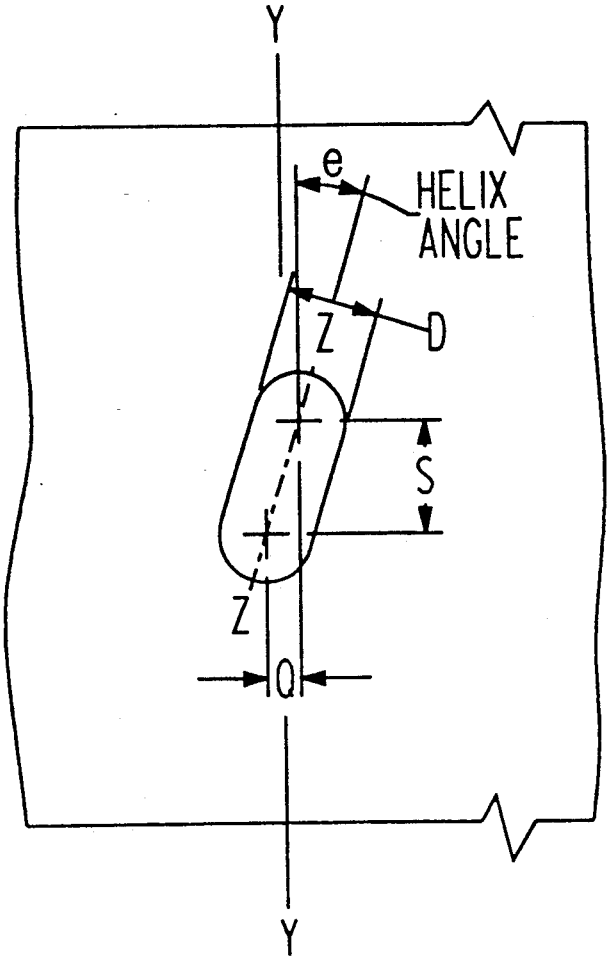
FIGS. 31 and 32 depict two examples of the preferred cam groove geometry viewed as though the cam sleeve were unrolled onto a plane (developed view).
Figure 32:
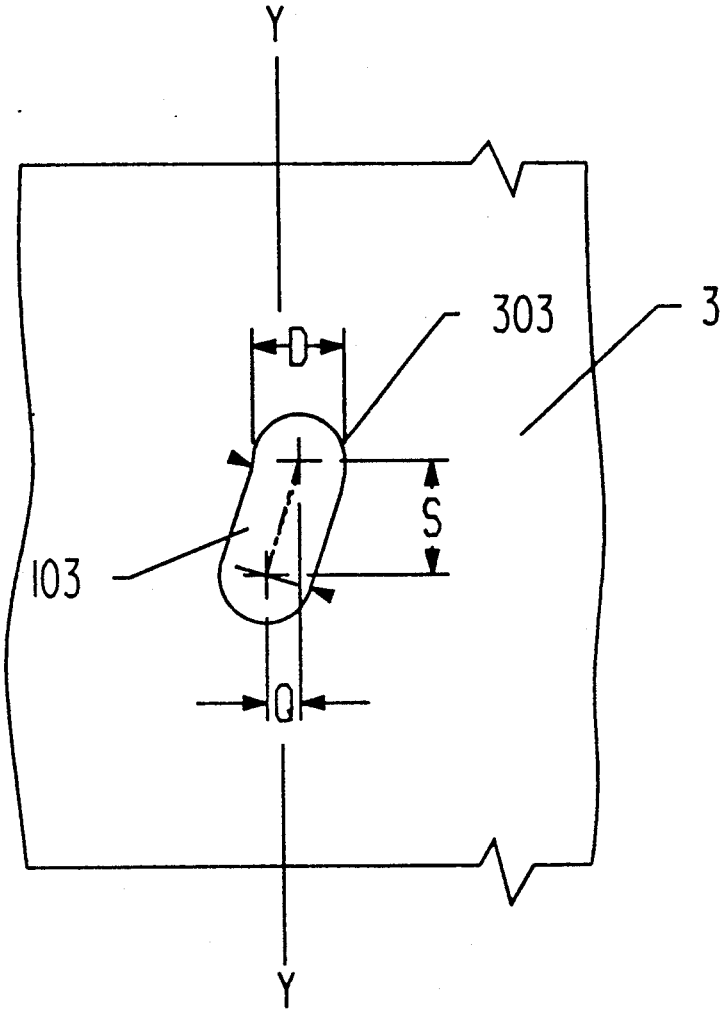

The center line of these slots 103, is essentially a helical curve, or when viewed in developed form, as in FIGS. 31 and 32, a straight line, Z. In this embodiment, any torque acting about the blade shaft axis Y, causes both rotational and radial translational movement at any position along the slot. The angle e, between the long axis Z of the slots 103,203, and a line parallel to the shaft axis Y, determines the relationship between angular pitch change and linear movement of the blades. Generally, this angle e is preferably at least about 5°, most preferably at least about 10°; the angle e is preferably not greater than about 50°, and most preferably not above about 30°.

Each collar 56 has appendages 156 and 256, extending outwardly from the center portion of the collar 56, which cap and hold the radially inward end of the coil springs 15 and 16, respectively. The radially outward end of the coil springs 15 and 16 are held within pockets 701, 801, formed in the inner surface of the outer hub case 201.

The rearwardly extending collar appendages 256 each are rigidly attached to a pin 57 which extends outwardly in a generally aft direction. A spherical ball joint member 81 is inserted over each pin 57 and is slidably rotatably held at one end of a link 80. At the opposite end of each link 80, a second spherical ball joint member 82 is slidably rotatably held, and a second pin 83 extends from the ball member 82 to a boss 184 on the coordinating ring 84. The pin 83 passes through the boss 184 and is rotatably connected to one end of a damping strut, generally indicated by the number 90; the pin 83 forms a pivotal connection to one end 290 of a damping piston rod 390. The damper cylinder body 490 has a trunnion 190 attached at its opposite end, which is journalled onto a pin 85, which in turn is pivotally connected to a boss 1401, fixed to the hub web 301.

Figure 23:
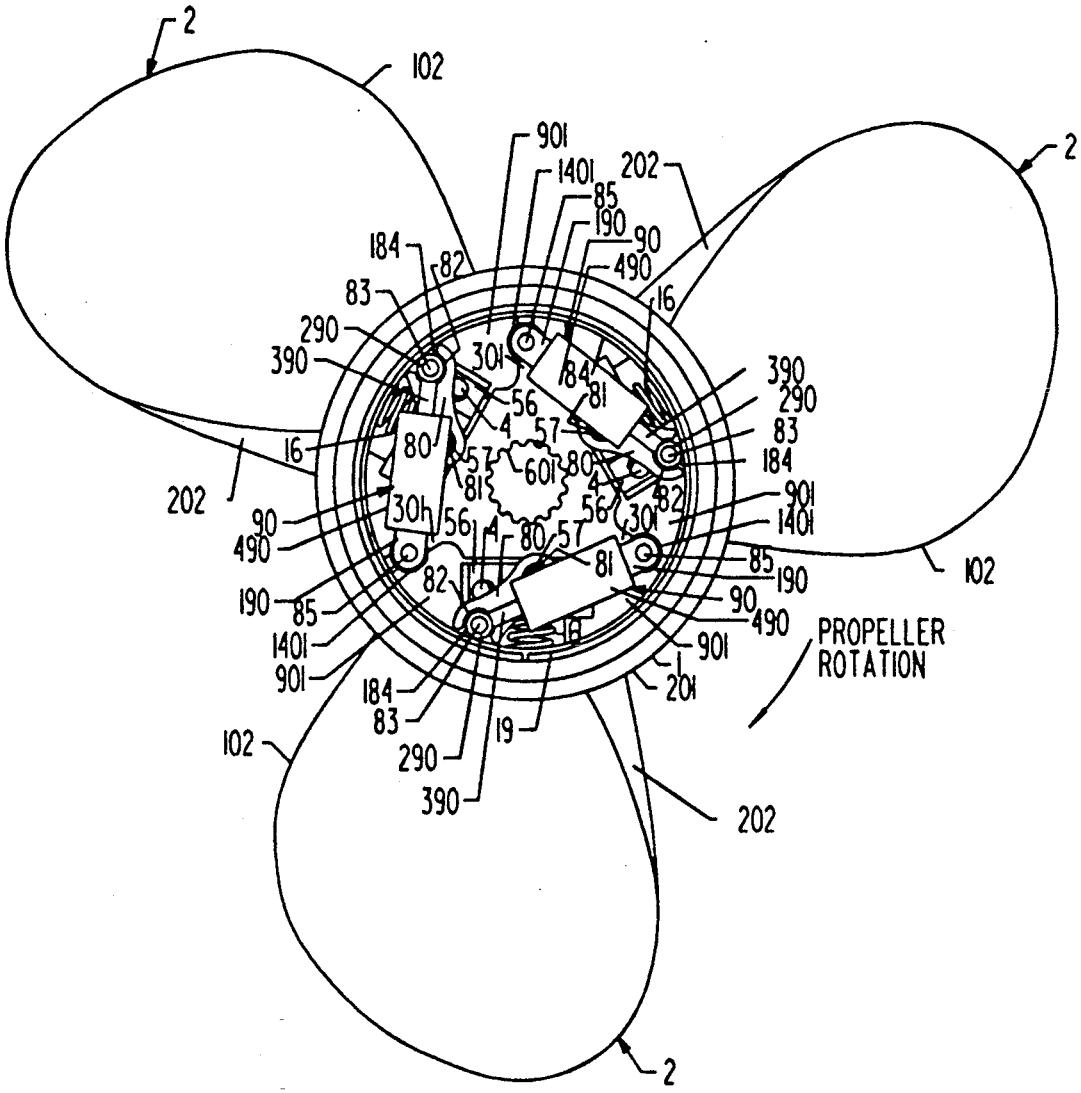
FIG. 23 is a rear view of a third embodiment of the propeller assembly having radially movable blades in combination with piston strut dampers, with the internal mechanism and blades located in the radially inward, low pitch limited position.
Figure 25:
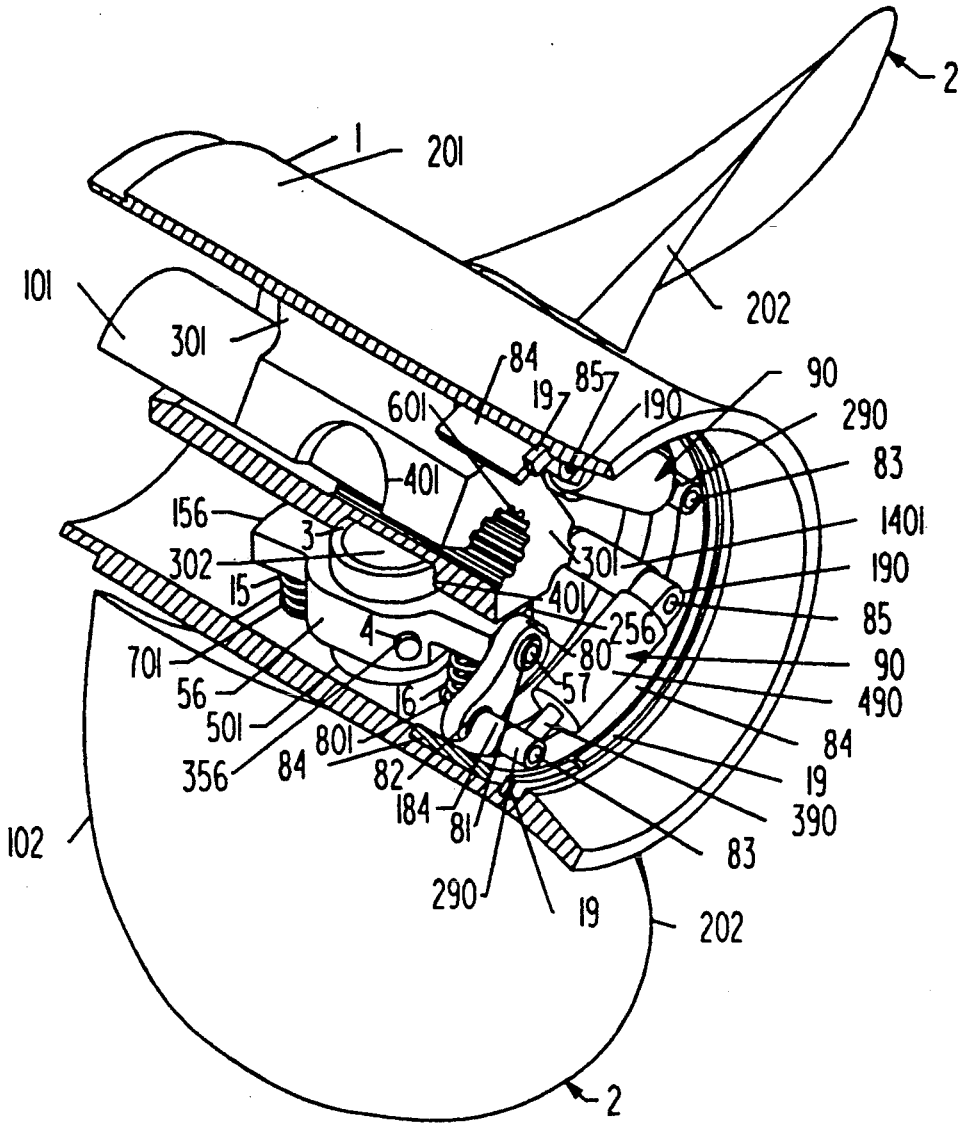
FIG. 25 is a sectional isometric view of the propeller assembly of FIG. 23 showing the mechanism for a single blade, with the internal mechanism and blades located in the low pitch limited position.
Figure 26:
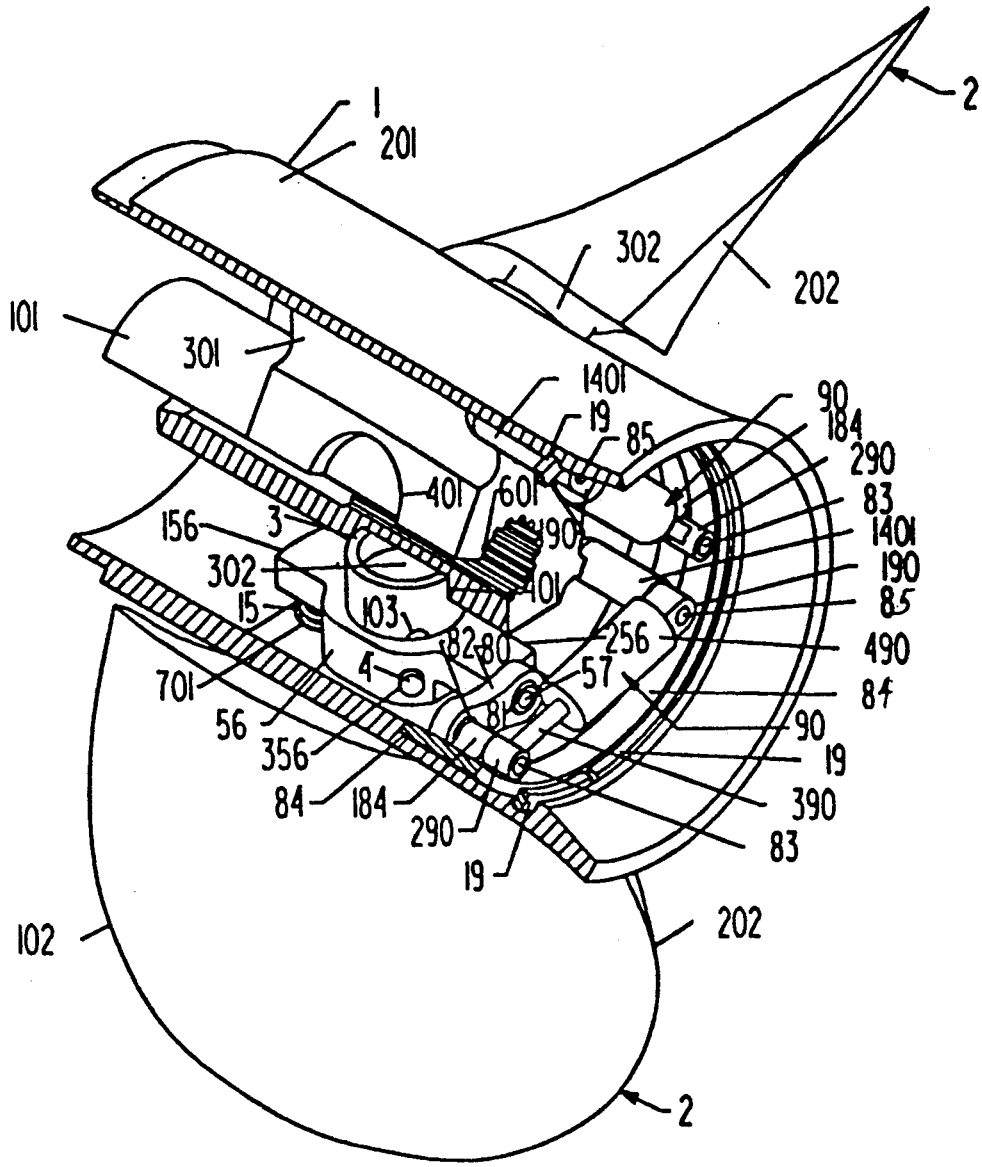
FIG. 26 is the sectional isometric view of the propeller assembly of FIG. 25 with the internal mechanism and blades located in the high pitch limited position.
Figure 27:
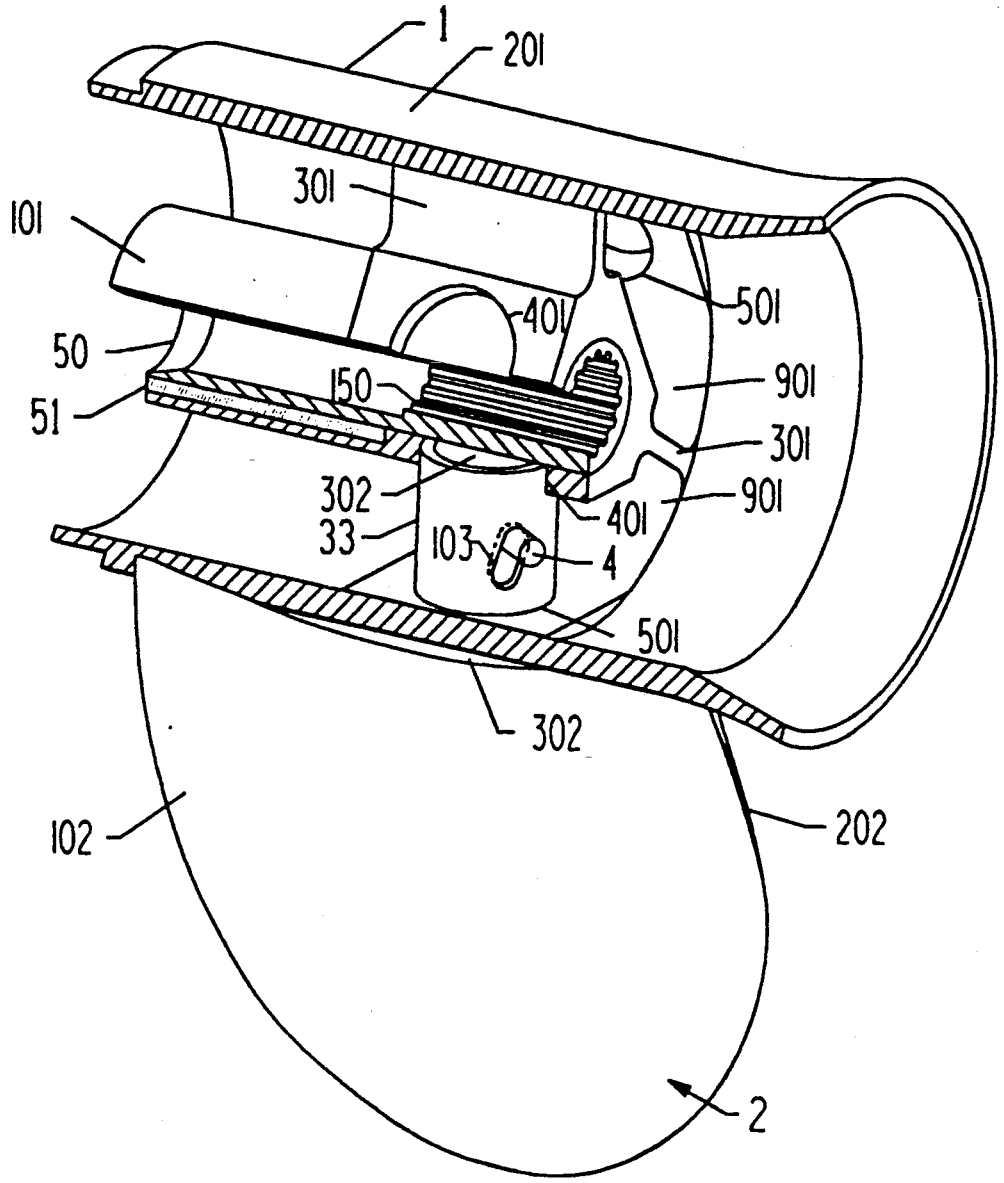
FIG. 27 is a partial aft isometric view of the propeller of FIG. 25, with most of the mechanism removed to show the cam sleeve and pin follower geometry for one blade, in the radially inward low pitch limited position.
Figure 28:
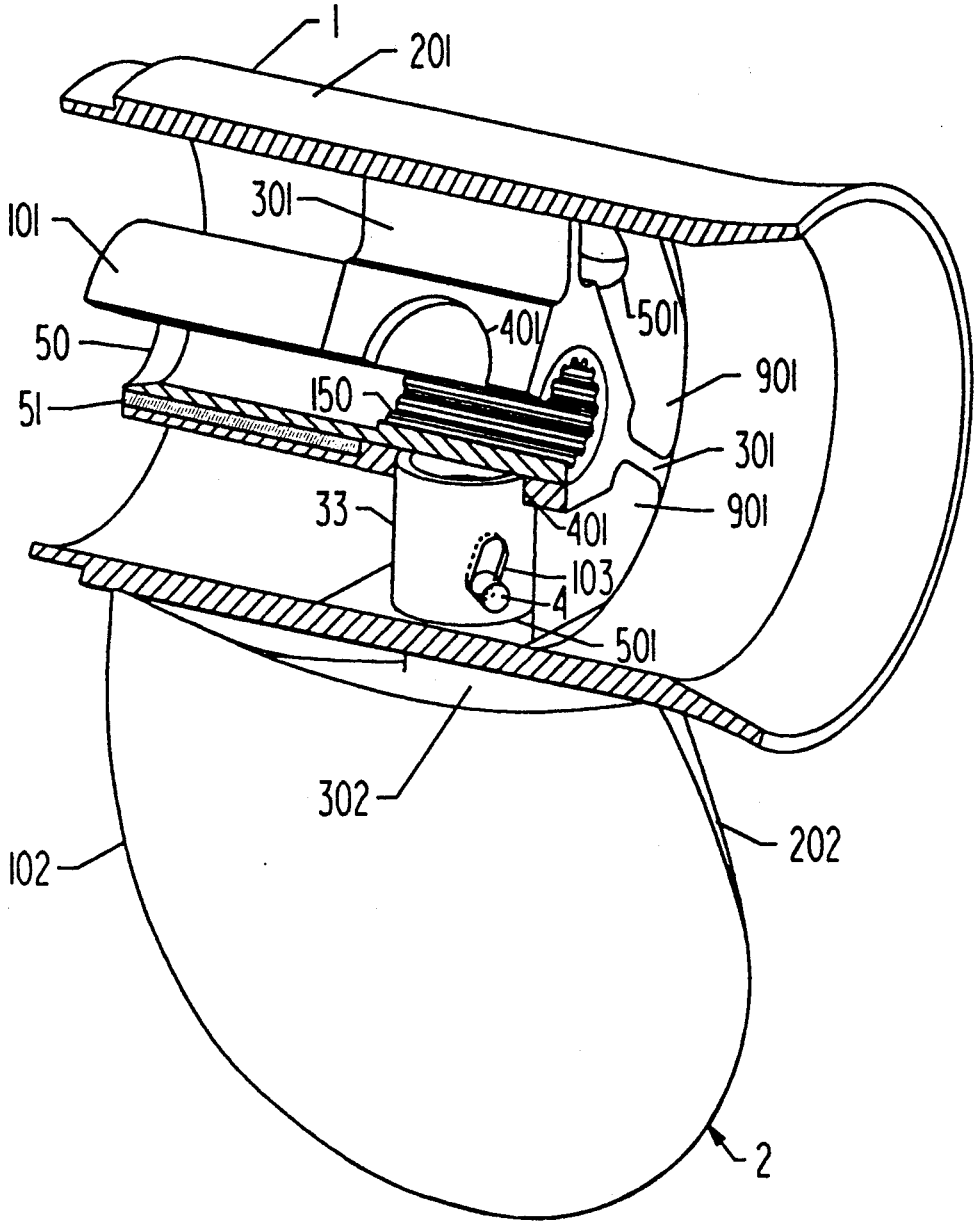
FIG. 28 is the partial aft isometric view of the propeller of FIG. 27, in the radially outward high pitch limited position.

The operation of this embodiment is as follows: With the engine and propeller at idle, or at a low rotational speed (RPM), the coil springs 15 and 16 position the collar 56 radially inward so that the entire mechanism is positioned in the low pitch limit position as shown in FIGS. 23 and 25. Upon increasing the engine power and attaining sufficient propeller rotational speed (RPM), the radially outward centrifugal force effect generated on each of the blades 2 and the collars 56 assembly masses, is sufficient to overcome the inward biasing force provided by springs 15 and 16, as well as any friction impedance, thereby causing the blade to move radially outward. The torque generated by any hydrodynamic forces acting on the blades can be additive to or oppose the centrifugal effect, depending upon the blades shaft location, as explained above. As explained, the effect of the helical cam groove slots 103, 203, is to create a rotary torque component out. of a linear radial force, and vice versa.

As the blade 2 moves radially outward, the blades 2 are each also rotated toward a higher angle of pitch, as guided by the cam groove slots 103, and acting against the pin 4. As the blade 2, pin 4, and collar 56 assembly rotate to a higher pitch angle and translate radially outward, springs 15 and 16 are compressed. Also the coordinating ring 84 is caused to rotate about the drive shaft axis, as a consequence of the link 80 connection between each collar 56 and the coordinating ring 84, thus insuring substantially simultaneous and equal pitch change for all of the blades 2.

As the coordinating ring 84 rotates, the damper strut 90 is extended (i.e. the linear distance between the centers of the two end pins 83, 85 increases, because the damper is pivotally connected at one end 290 to the coordinating ring 84, by a pin 83, while the other end 190 is pivotally anchored to the hub web 301 via the other pin 85; thus any change in the rate by which the length of the damper strut 90 increases or decreases, directly changes the rate of angular rotation of the coordinating ring 84, and thus of the blades 2. Thus, the level of damping provided by the damping struts 90 controls the rate at which the pitch of each blade is allowed to change.

As in the above embodiments, a reduction in engine power and propeller rotational speed (RPM), generally reduces the radially outward centrifugal force effect, and changes the hydrodynamic force components, until the resultant outward force and pitch increasing torque is overcome by the radial inward force effect provided by the coil springs 15 and 16, which results in the retracting of the blades 2 and associated rotary movement towards the low pitch limit position, as a result of the effect of the cam grooves, 103 and 203 acting against the pin 4. As depicted in FIGS. 23–26, the coil springs 15 and 16 are compressed between the appendages 156, 256 and the hub outer case 201, when the blades move radially outwardly and twist towards a higher pitch position, and extend to an unstressed condition when the blades 2 retract and rotate towards a lower pitch position.

With the configuration depicted by FIGS. 23–26, the damper struts are so arranged with respect to the hub web 301 and the coordinating ring 84, that the strut elongates (or is extended) as the blades move towards a higher pitch position, and the strut 90 is retracted (i.e. the linear distance between the centers of pins 83 and 85 decreases) when the blades return to a lower pitch position. It is clear that the arrangement can be changed to reverse the action of the damper strut. However, in either case, the damper 90 can, depending upon its internal construction, provide a damping impedance with respect to the motion of the blades 2 towards either or both of the low and high pitch limit positions.

Figure 24:
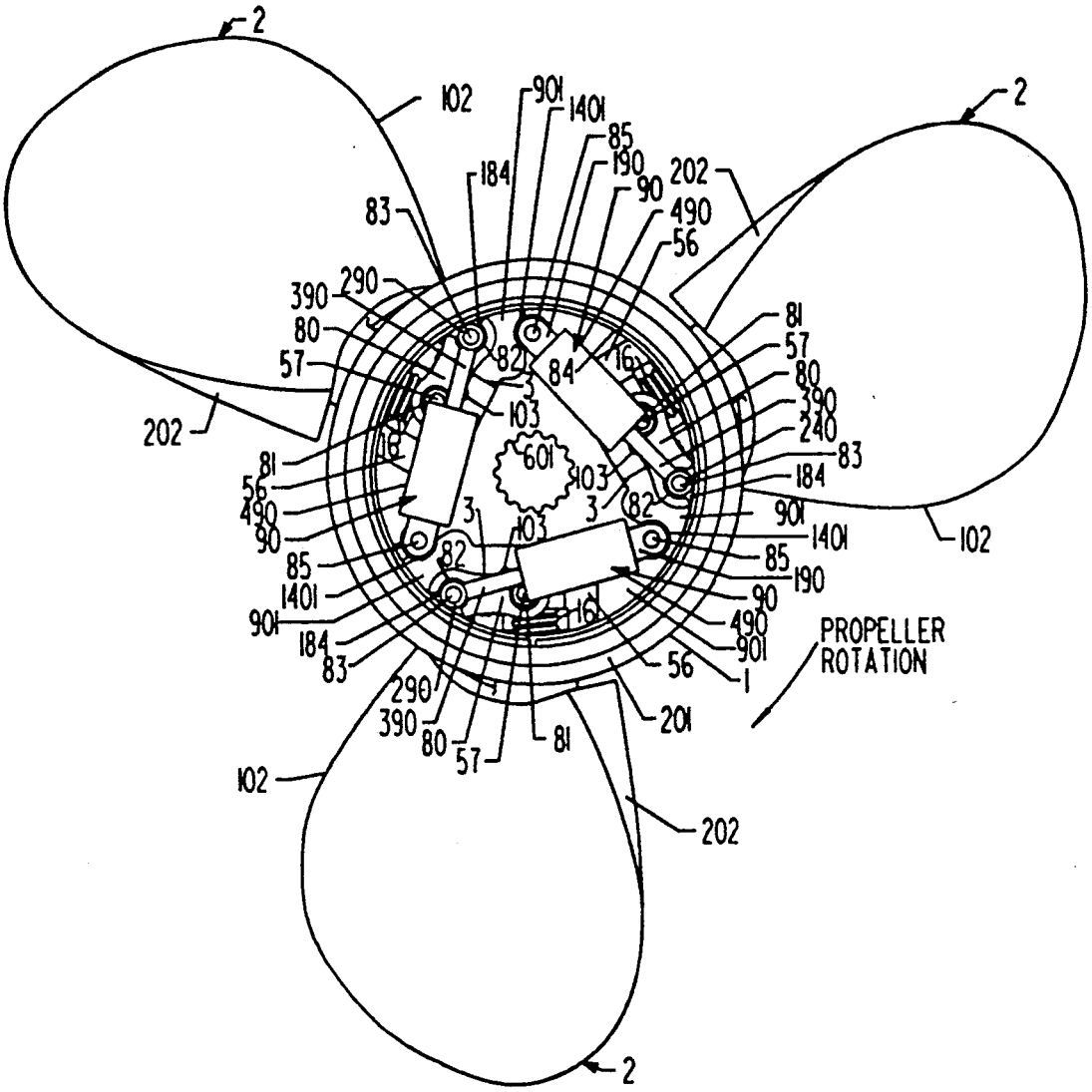
FIG. 24 is the rear view of the propeller assembly of FIG. 23 with the internal mechanism and blades located in the radially outward, high pitch limited position.

The addition of the damper struts 90 thus provides effective means to control the rate-of-change in both the angular and translational motion of the propeller blades 2 relative to the hub 1. The design and construction of these damper struts is well understood within the present art, and generally involve the forcing of a viscous fluid through an orifice. The design of these dampers can be varied to limit damping to either or both of the extended or retracted directions, but can also provide for manual adjustment of the level of damping effect. Although FIGS. 23 and 24 show three damper struts 90 arranged for symmetry, any number of dampers can be used depending upon the level of damping provided by each damper and the total amount of damping required to achieve the desired propeller pitch angle rate of-change. Since maintaining the rotational balance of the propeller is also of importance, if, for example, only one damper strut 90 is utilized, it is necessary to otherwise balance the system, i.e., by attaching suitable counterweights to the hub 1 to counter balance the damper strut mass.

Figure 29:
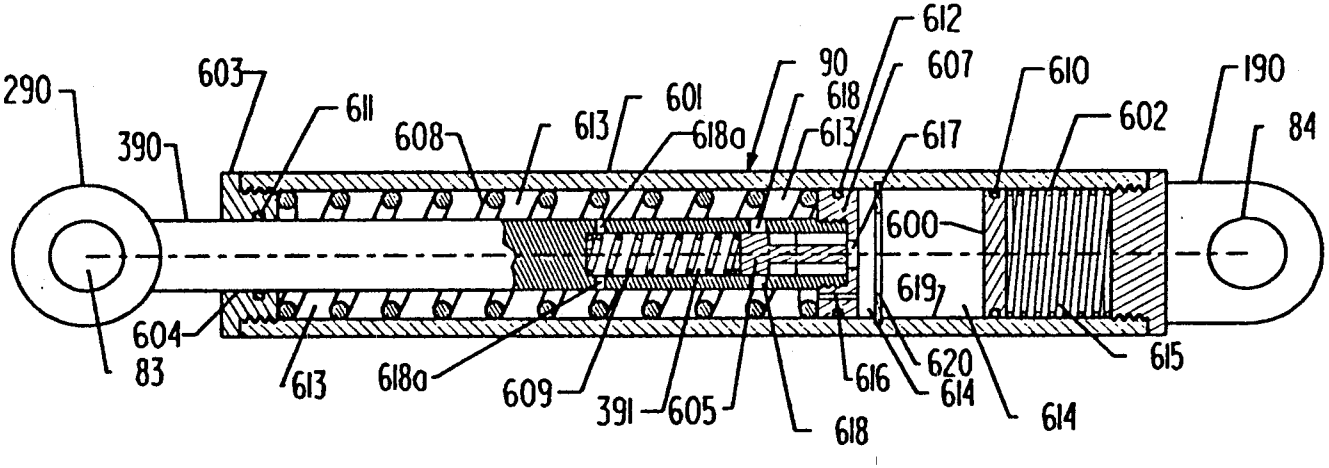
FIG. 29 is a cross sectional view of a typical piston strut type damper.
Figure 30B:
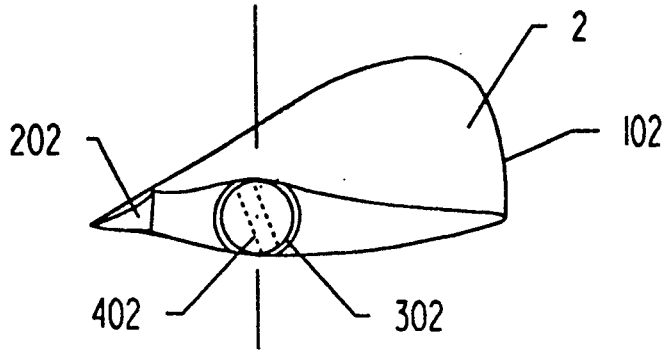
FIG. 30*b* is a top view of the propeller blade in FIGS. 25–28 and 33–36 looking radially outward along the blade shaft axis Y.
Figure 30A:
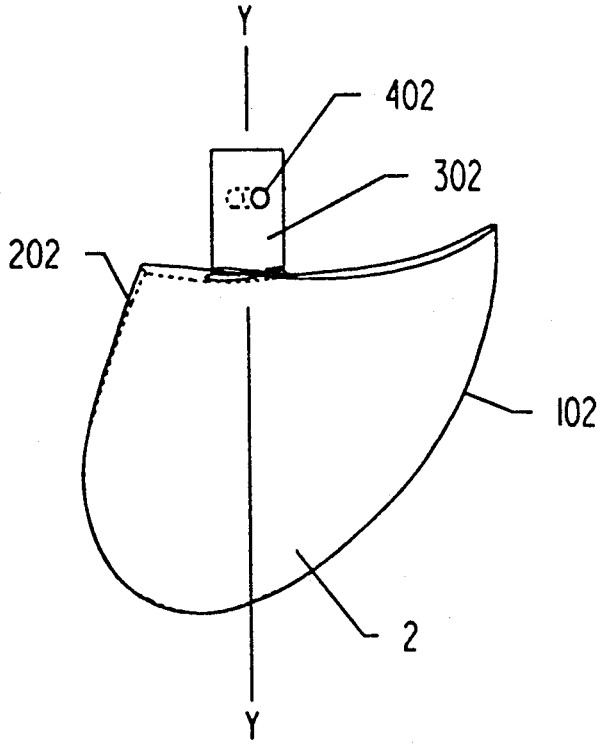
FIG. 30*a* is a side elevation view of a typical propeller blade used for some of the embodiments of FIGS. 25–28 and 33–36 wherein the shaft is located forward of the blade center of pressure.
Figure 30C:
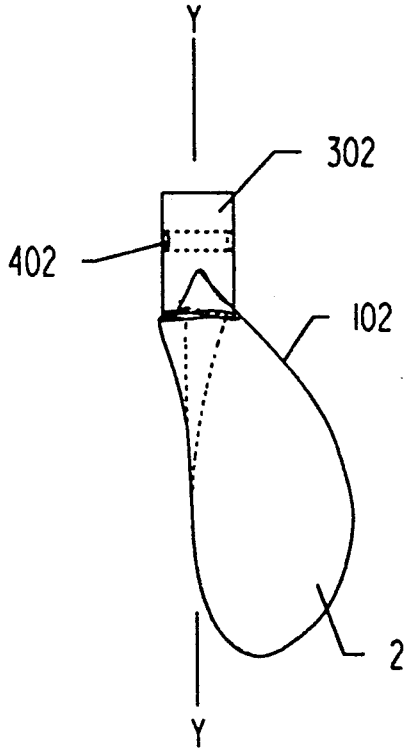
FIG. 30*c* is a rear view of the propeller blade in FIGS. 25–28 and 33–36.

An example of damping strut design is presented in FIG. 29, where it is shown in the retracted position. The damping strut, generally indicated by the number 90 is composed of a cylindrical housing 601 rigidly connected at one end to a gudgeon 190, which is in turn, pivotally connected to a pin 84. The pin 84 secured, at its other end, to the propeller hub 301. At the opposite end of the housing 601 is end cap 603. The actuating rod 390 is inserted through a central bore 604 provided in end cap 603. This bore 604 also incorporates a ring seal 611. The external end of the actuating rod 390 is rigidly connected to rod end gudgeon 290. The rod end gudgeon 290 is pivotally connected to a pin 83, which is secured to the rotating pitch change mechanism, e.g., the coordinating ring.

Within the damping strut cylindrical housing 601 is a piston 607 which partitions the interior of the cylindrical housing 601 into viscous fluid chambers 613 and 614. The piston 607 is affixed to the internal end of the actuating rod 390. Piston 607 includes a ring seal 612. The piston 607 also contains a fixed orifice 616 and a by-pass channel 617. Also contained within chamber 613 is an optional biasing spring 608, shown acting against the piston 601 tending to bias the actuating rod 390/piston 607 assembly toward the retracted position. Contained within an interior spool cavity into the actuating rod 390 is a check valve spool 605 and a retaining spring 609. Two pair of lateral openings, 618*a*, 618 in the rod 390 connect the interior spool cavity with piston cavity 613.

Also sealably slidably held within the cylindrical housing 601 is a volume compensation piston 600 which incorporates a ring seal 610. The volume compensation piston 600 partitions the cylindrical housing bore 619 into a viscous fluid chamber 614 and a gas chamber 615. Contained within the gas chamber 615 is an optional compensation piston biasing spring 602. A retaining ring 62O, affixed to the interior surface of the cylindrical housing 601, provides a stop for the volume compensation piston 600.

The operation of the damping strut 90 shown in FIG. 29 is as follows: the compression spring 608 initially positions the actuating rod 390, piston 607 and check valve 605 assembly in the retracted position shown in FIG. 29. Upon an increase of the relative distance between pins 84 and 83, the actuating rod 390 moves outwardly, thereby moving the piston 607 toward the end cap 603 and compressing the spring 608. As the piston 607 is displaced, a proportional volume of viscous fluid contained in the cylinder chamber 613 is forced through the piston orifice 616 and into chamber 614 thereby providing viscous damping to the extension motion of the actuating rod 390. As the actuating rod 390 extends further out at the housing 601, the volume compensation piston 600 moves in the same direction (i.e., towards the retaining ring stop 620) as the piston 607;, but at a slower rate in response to the reduced pressure in the chamber 614. As the volume compensation piston 600 moves, the compression of spring 602 is reduced and the gas (air) in chamber 615 expands.

Upon a decrease in the relative distance between pins 84 and 83, the actuating rod retracts into the cylinder housing 601, thereby moving the piston 607 towards the pin 84 and reducing the compression of the main spring 608. As the piston 607 is displaced, the differential pressure created between chambers 614 and 613 causes the check valve spool 605 to further compress the rod spring 609, eventually opening the check valve ports 618. As the spool 605 is displaced, viscous fluid in the rod chamber 391 exits through the drain ports 618*a*. Once the check valve ports 618 are open, the viscous fluid in chamber 614 can flow more easily from chamber 614 back into chamber 613, thus allowing a faster retraction notion than that allowed for the extraction motion. Also, as the actuating rod 390 is retracted into the housing 601, the volume compensation piston will be displaced towards the pin 84 compressing the forward spring 602 and the gas (air) contained in the forward chamber 615.

The addition of damping can provide significant stability to the operation of self actuating, infinitely variable pitch position propellers. Consequently, with the addition of damping control means to the blade positioning mechanism, a simple helical shape, such as that shown in FIG. 31, can be used for the cam groove slots 103, 203 in sleeve 3, while obtaining stable operation. However, the concept of damping can also be used in conjunction with any blade position restraining means such as is provided by the cam groove slot design of FIG. 32, and the various slot designs shown in U.S. Pat. No. 5,129,785.

As shown in this application and in the earlier copending applications referred to above, variable pitch propellers can include restraining means to lock or hold blades in position; and means to restrain the blade rate-of-change in position (damping), which alone or in combination can provide effective and stable operation to a broad range of propeller pitch change concepts, including those having discrete operational positions, infinitely variable positions, or combinations thereof. Some of the important design factors to be considered include the following:

1) Blade shape and hydrodynamic loading;
2) Blade pivot center location;
3) Blade mass and inertia loading;
4) Propeller rotational speed (RPM) range;
5) Engine power range and torque;
6) Boat speed range weight and hull design;
7) Blade positioning mechanism kinematics and force relationships;
8) Mechanism spring deflection and force characteristics (if utilized);
9) locking or holding mechanism characteristic (if utilized);
10) System damping.

For the discrete pitch position concepts, adding a high level of damping as a means to increase the transition time when the blades have been released from a locked, or held, low pitch position to a high pitch position, allows the propeller to effectively and stably operate during the transition, thus generating additional thrust. A damped, slower blade pitch transitional motion can further improve the propeller operation on very high power boats or when the net change in pitch from low to high position is significantly large, e.g., 8 degrees or higher, because flow disturbances generated by a fast acceleration, or rapid blade pitch angular change motion, can cause flow separation, resulting in substantial loss in propeller thrust. This propeller flow separation, commonly called "blowout", can also result in engine overspeed. Slowing the rate at which the propeller blade can rotate from the low to the high pitch limit positions can significantly reduce blade hydrodynamic flow disturbances, and, thereby prevent propeller "blowout".

It is also possible to utilize a high damping level as the primary control means to regulate the blade pitch position. If, for example, a blade having an aft positioned shaft, FIGS. 22*a–cm* is utilized with a blade positioning mechanism having low and high pitch limiting means, but no blade position locking or holding means, such as is shown in FIGS. 2 through 9, upon the application of significant engine power, the hydrodynamic loads exerted forward of the blade shaft pivot center, bias the blades toward a higher angle of pitch. Without either damping or locking, or holding, means, the large pitch change moment generated about the blade shank immediately upon advancement in significant engine power, causes the blade to prematurely rotate into the high pitch limit position.

However, with the addition of a high level of damping control means, the time required to move from the low pitch limit position to the high pitch limit position can be greatly increased, such that the transition time coincides with approximately the time required to accelerate the boat from rest to cruising, or hull planing, speed. If the damping means also includes manual or automatic means to vary the amount of damping, the transition time required by the propeller blade, to move from the low to high pitch limit position, can be readily adjusted to provide optimal performance for any boat or operational condition. For typical outboard or stern drive powered pleasure boats, with planing type hulls of between 16 to 35 foot lengths, the required blade transition and/or boat acceleration time period from rest to planing speed is generally between 5 to 15 seconds; boat maximum power-to-weight ratio being a dominant factor for these acceleration times. The precise time at which a boat becomes "planed" is sometimes difficult to establish, thus a predetermining speed (e.g. 25 mph) or distance (100 ft.) can also be used to evaluate boat acceleration performance.

The level of damping that could be considered sufficiently high to effectively slow the rate-of-change in position of the blades may also be defined as a percentage of the critical damping value for blade and actuating mechanism.

For simple, one-degree of freedom analytical models, the overall critical damping value ($C_{cr}$) can be determined from the following general equation:

$$(C_{cr})=2IWo$$

Wherein:

I=effective inertia (or mass) of the combined blade and mechanism with respect to the system's fundamental mode of oscillation; and Wo=the fundamental frequency of oscillation of the combined blade and mechanism (as determined either by empirical measurement or by analytical calculation).

Figure 8:
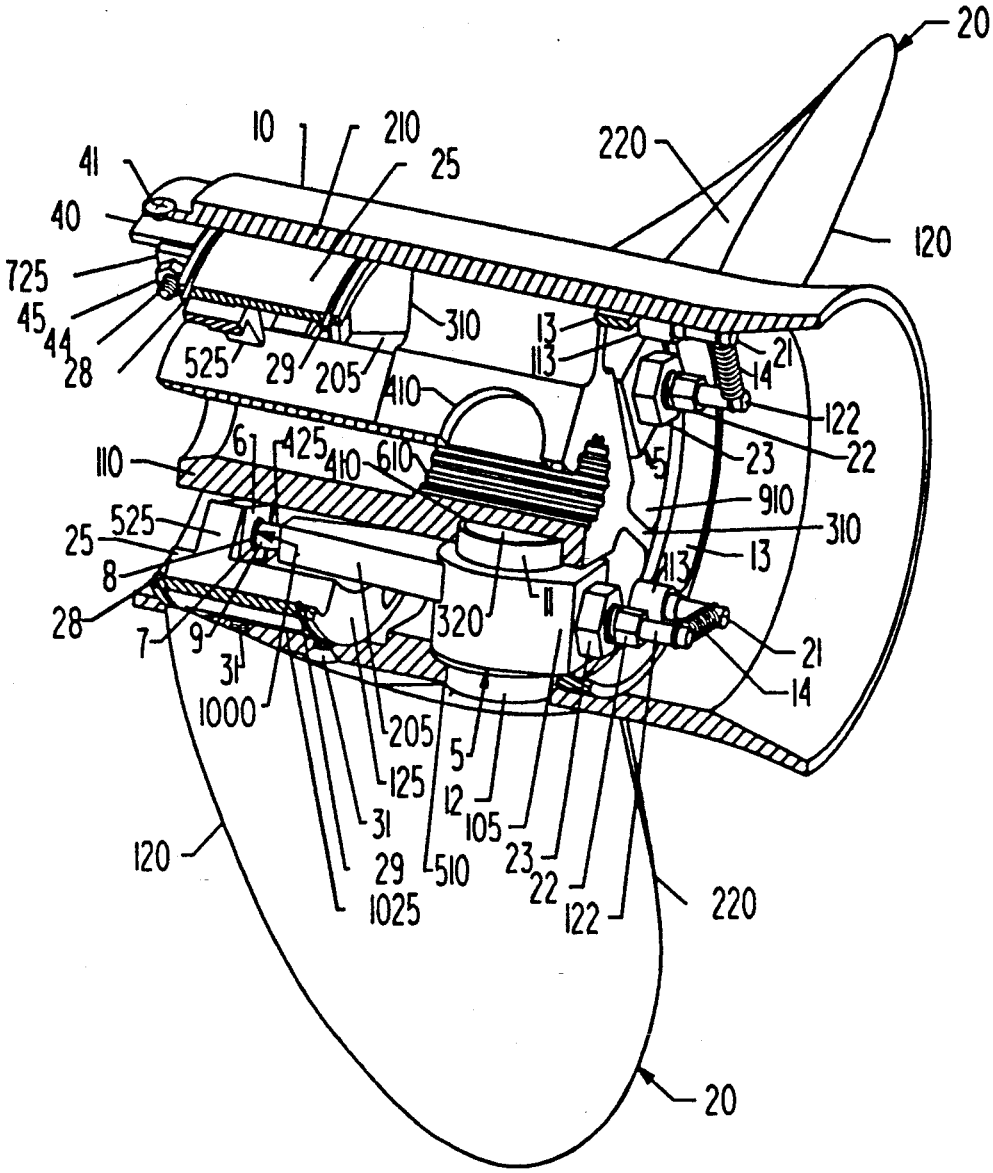
FIG. 8 is another random isometric sectional view showing the mechanism components for one blade, with the components in the low pitch limited position.
Figure 9:
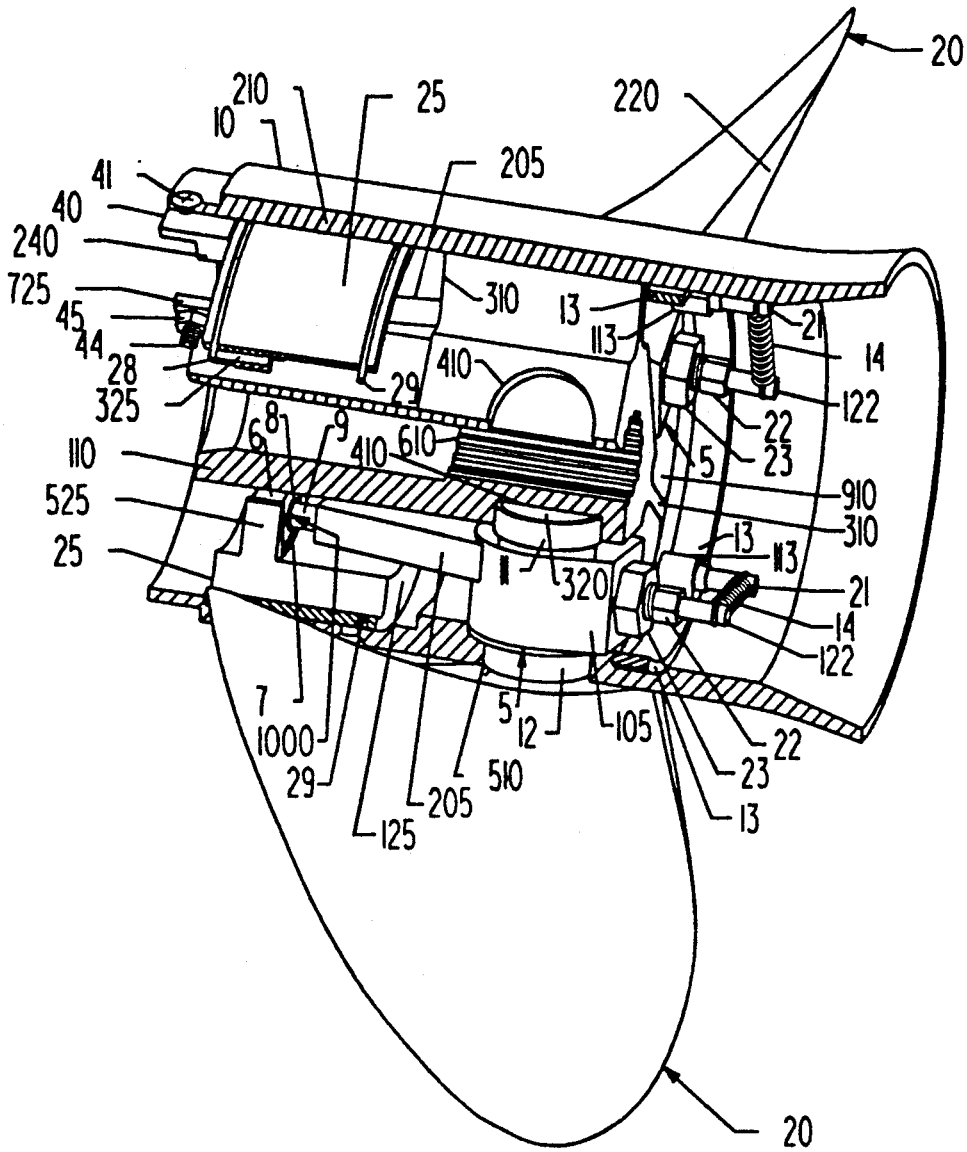
FIG. 9 is the random sectional view as in FIG. 8, showing the mechanism components for one blade, with the components in the high pitch limited position.

The "combined blade and mechanism" referred to above includes all, of the parts which move together with the blades relative to the hub case, e.g., the coordinating ring 25, in FIG. 8.

When it is desirable to analytically calculate the critical damping values, rigorous dynamic analysis methods are readily available from current engineering literature. Often, a reasonable approximation of the critical damping value of a spring-biased system can be obtained by merely computing the value for the spring-mass aspect of the system, disregarding the other forces in the system, such as the hydrodynamic forces and the inertial forces. Texts which discuss the procedures to determine the critical value for a spring-mass system include, e.g., *DYNAMICS OF VIBRATIONS,* by Enrico Volterra and E. C. Zachmanoglow, (Merrell Books, 1965). The critical damping value should be determined for each type of motion in a given system, i,.e., where the blades can only rotate, as in FIGS. 2–9 and 17–20, for rotational oscillation, and for the embodiments of FIGS. 23–28 and 33–37, for both rotational oscillation and radial motion oscillation.

Accordingly, the critical spring-mass system damping value for blade pitch angle, or rotational, oscillations can be approximated using the following equation:

$$C_{cr} = 2\sqrt{K_t I}$$

where $C_{cr}$=critical Damping value $K_t$ Effective blade pitch angle torsional spring rate.

I=Effective Blade torsional moment of inertia

Similarly, for cases involving blade radial translation, the critical damping value for this mode of spring-mass oscillation can be approximated using the following equation:

$$C_{cr} = 2\sqrt{mk}$$

where:

$C_{cr}$=Critical Damping Value, m=Effective Blade Mass.,

K=Effective Blade spring rate in radial direction.

Unlike aircraft propellers, the hydrodynamic loading on marine propeller blades can reach significant magnitudes, relative to the mass of the blades; in the context of the variable pitch marine propellers of this invention, such hydrodynamic loading can be, effectively, the dominant factor driving the blade and mechanism to change angular pitch position, especially where the bias spring is relatively weak. These hydrodynamic force oscillations often have to be considered in evaluating the required level of damping to eliminate flutter. Analytical methods for determining the magnitude and frequency of the hydrodynamic force oscillations and the magnitude of critical damping, are presented in such current engineering literature as, e.g., *FLUID DYNAMICS,* by James W. Daily and Donald F. Hardeman (Addis-on-wesley Publishing, 1966) and *PRINCIPLES OF AEROELASTICITY,* By Raymond L. Bisplinghoff and Holt Ashley (Dover Publications, 1962).

High or heavy system damping can generally be defined as a damping level greater than the critical damping value. Thus, providing a level of damping equal to or greater than the propeller mechanism's critical damping value will have the effect of significantly slowing the rate-of-change in blade pitch position. On the other hand, if it is desired to simply stabilize a self-actuating, infinitely variable pitch position propeller, such as is shown in FIGS. 23 through 26, then only a modest level of damping may be required. It is estimated that damping levels as low as 25% of the system critical damping value can be sufficient to provide acceptable stability to these self-actuating, infinitely variable pitch propeller system over their expected operational RPM ranges.

In U.S. Pat. No. 4,729,279 to Bergeron, a variable pitch propeller design is described wherein the blades move radially in a manner similar to the design presented above, in FIGS. 23 through 26. However, stable operation of Bergerson's design requires maintaining a sensitive equilibrium of blade inertial forces and hydrodynamic forces; the wide operational range with respect to boat speed and propeller speed combinations during acceleration and in normal cruise operation, makes it very difficult to avoid the oscillations which result in blade flutter.

However, applying the concepts of viscous damping is effective to control or prevent blade instabilities and then flutter, in the Bergeron design, that is, by incorporating a damping strut, as presented in FIGS. 33 through 36, blade flutter is drastically reduced, or eliminated.

Referring to FIGS. 33 through 36, there is provided a propeller hub, generally indicated by the number 8001, comprising an outer hub case 8201 having three radially extending cylindrical bores 8501 therethrough; a primary blade shaft 8302, on each of the three blades 8002, is inserted into each bore 8501. The hub 8001 also includes a central interior surface 8401, defining a single central axial bore through an inner hub 8101; the rearward end of the inner cylindrical surface 8401 is formed to define splines 8601 to accommodate the torque transmitting attachment to the propulsion drive shaft of a marine engine.

Hub spokes 8301 rigidly connect the inner hub 8101 to the outer hub case 8201. Defined circumferentially between the hub spokes 8301 are axially extending exhaust gas passages 8901, to accommodate engine exhaust flow through the hub 8001 from the marine engine. Axially cylindrical cavities 8701 extend through each hub spoke 8301 from the rearmost end into the radial bores 8501. A cylindrical cam pin 8004 is inserted into each cylindrical cavity 8701, and the smaller diameter forward end of each cam pin 8004 engages into a cam groove 8502 formed in each primary blade shaft 8302. The rearmost end of the axial cylindrical cavity 8701 is formed with an internal thread, and an allen head set screw 8022 is secured thereto to retain the cam pin 8004 in the cavity.

A coordinating ring 8084 is slidably secured around the aft portion of the outer hub case 8001, being both rotatable about, and translatable along, the drive shaft axis, X. A secondary shaft 8402 is secured to each blade 8002, extending from the extreme aft region of the blade root section 8202, along an axis substantially parallel to the axis of the primary blade shaft 8302, and towards the inner hub 8101. Each blade secondary shaft 8402 is inserted through a slot 8184 contained in the external, aft coordinating ring 8084, and extends into an exhaust gas passage 8901.

A damping strut is located in each exhaust passage channel 8901 and includes a damping cylinder 8090 and a damping rod 8390. The forward attachment gudgeon 8190 of the damper strut cylinder 8090 rotatably holds a ball joint member **8190*a* through which is slidably inserted an anchor bolt 8085; the anchor bolt 8085, at one end, is laterally supported within a bore hole provided through the outer hub case 8201, and extends through the spherical joint 8190, through a cylindrical spacer 8086, and is threadably secured into a hub spoke 8301**.

The damper actuating rod 8390 extends in a generally aft direction within a hub exhaust passage 8901 and terminates in an aft attachment gudgeon 8290, also holding a spherical ball joint **8290*a* which slidably holds each blade secondary shaft 8402 and is secured by retaining ring 8087**.

The damping strut 8090/8390 can provide constant damping in one or both directions or the strut can be designed to vary the damping effects, in a manner similar to that described in the previous embodiments presented herein. In this embodiment, the blade shaft 8302 is generally forward on the blade, which generally results in the blade hydrodynamic forces tending to rotate the blades to a lower pitch position. The damper strut 8090 may contain a spring member 608, as is shown, for example in FIG. 29, to bias the strut initially towards the retracted position, thereby initially positioning the blades at the radially inward low pitch limit position.

Figure 33:
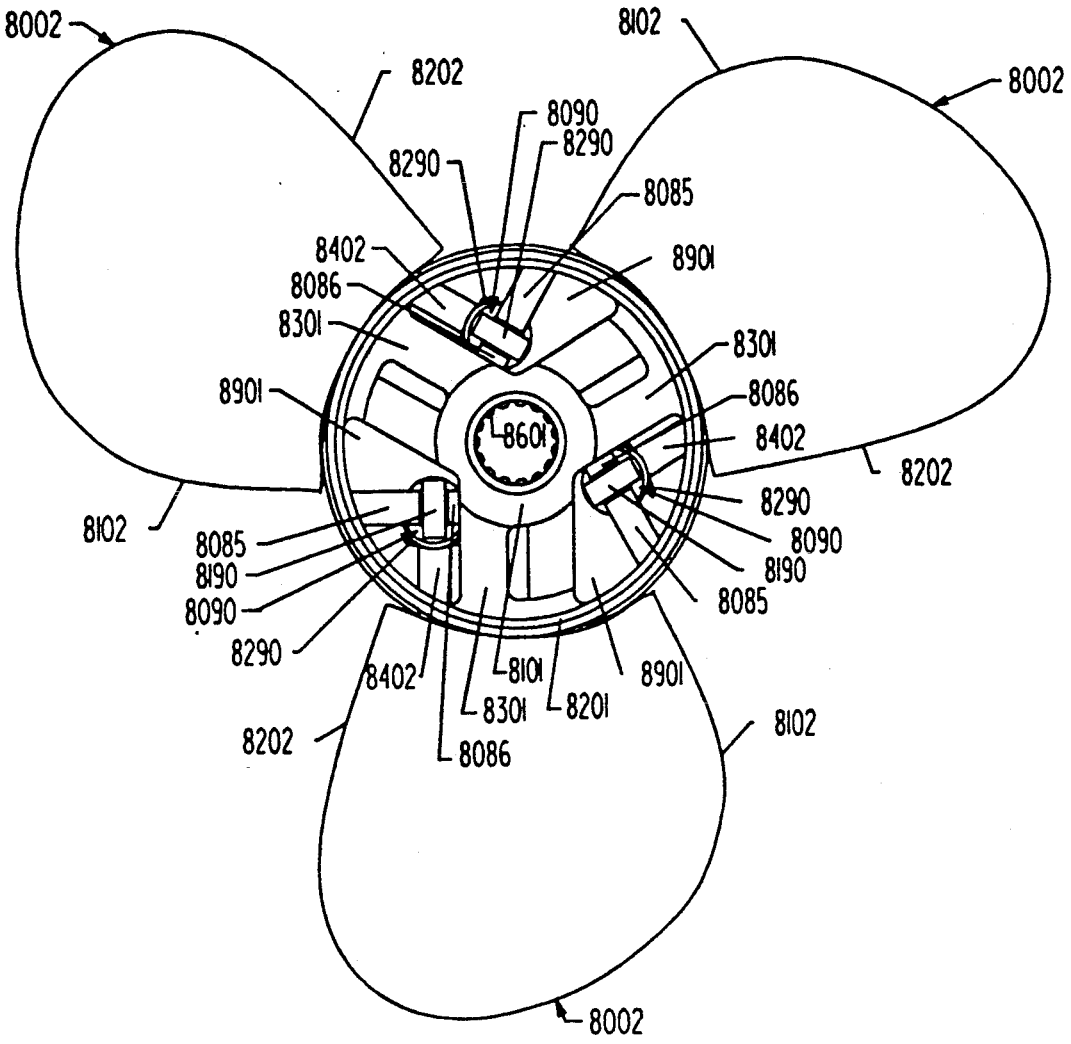
FIG. 33 is a front view of another embodiment of the variable pitch propeller of this invention, having a radially movable blade and a damping strut connected between the hub and each blade shaft, with the blades and internal mechanism positioned in the low pitch limited position.
Figure 34:
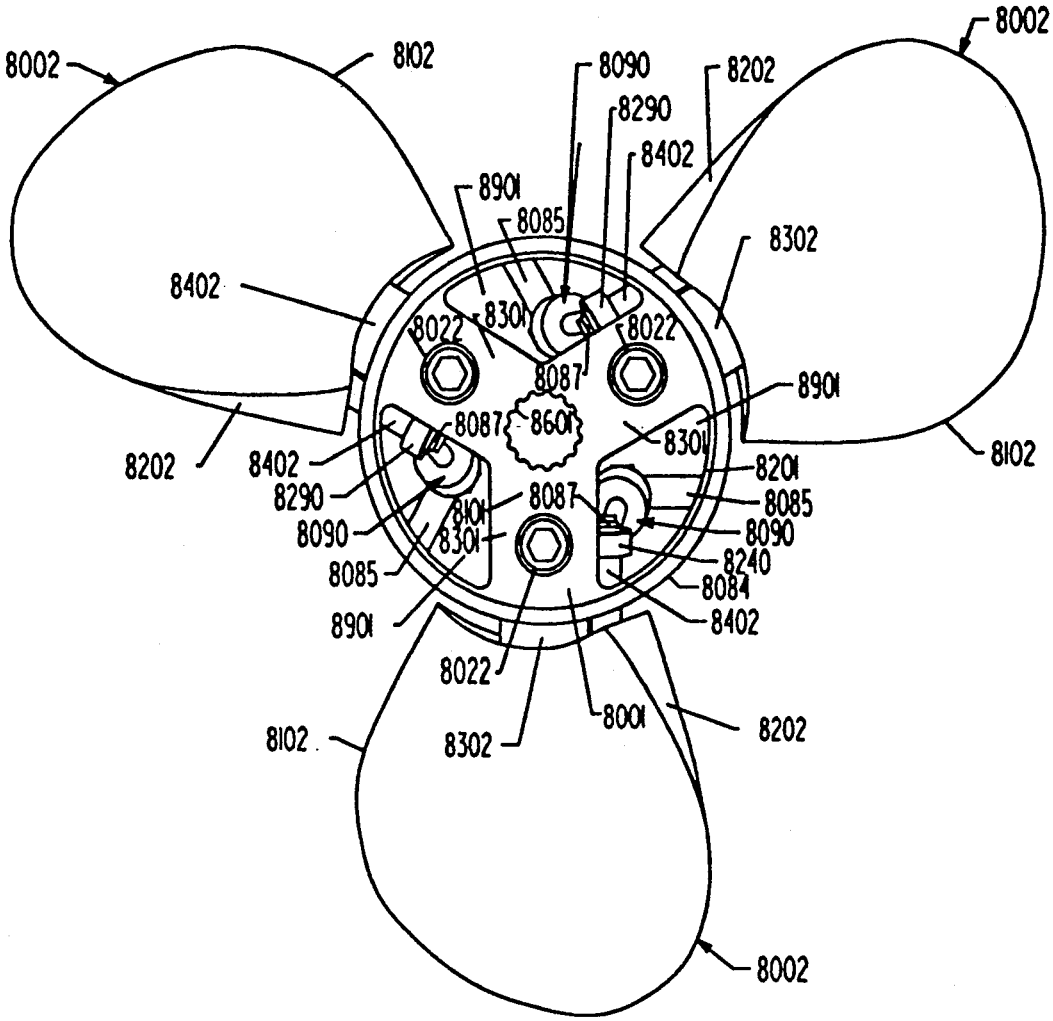
FIG. 34 is a rear view of the embodiment shown in FIG. 33, with the blades and internal mechanism positioned in the high pitch limited position.
Figure 35:
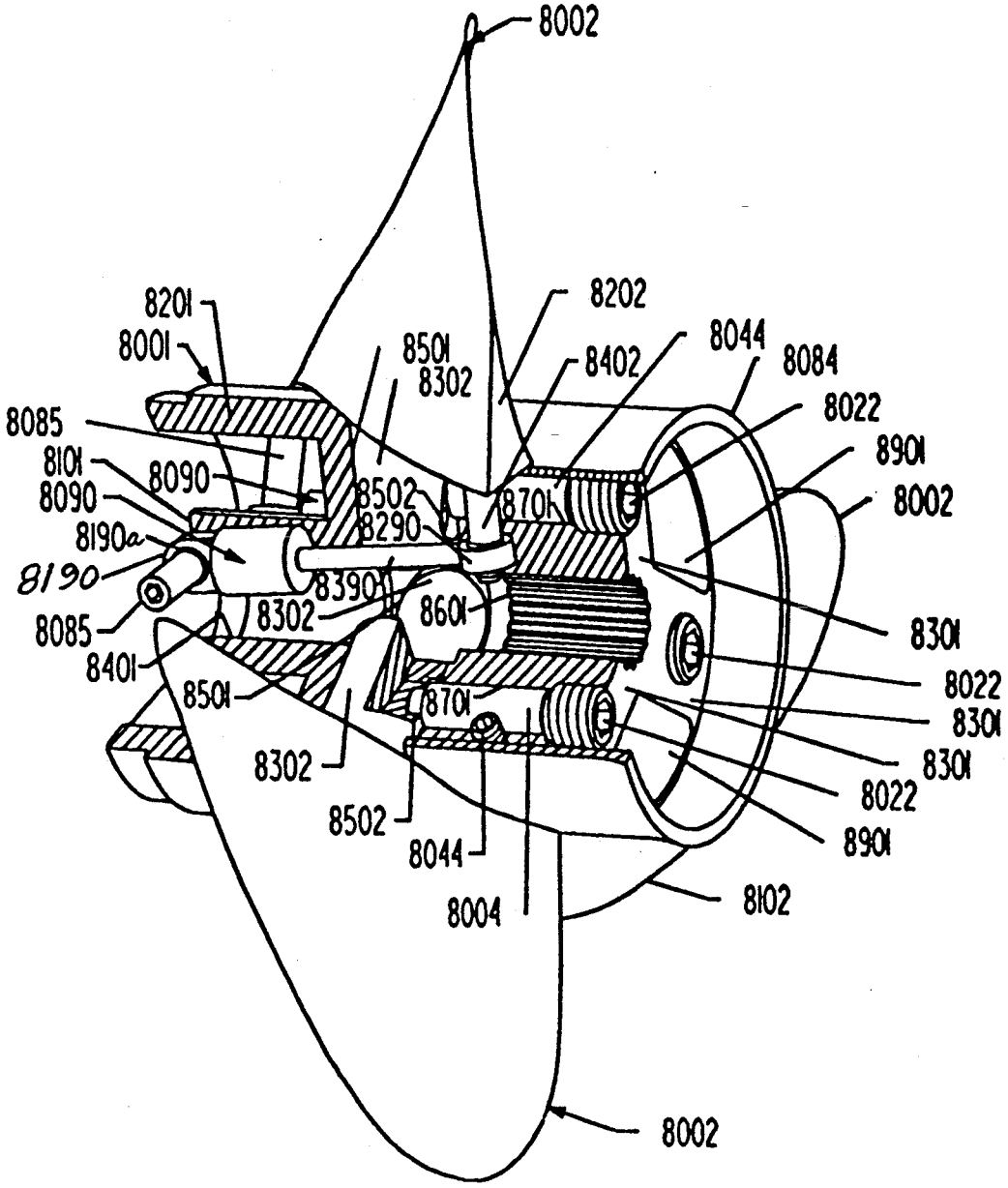
FIG. 35 is a random section isometric view of the propeller of FIG. 33, showing the internal parts in the low pitch limited position.

The operation of the embodiment shown in FIGS. 33 through 36 is as follows: with the engine and propeller at idle or at a low rotational speed, the internal spring biasing means 608 acts to hold the strut 8090 in a retracted condition, thereby holding the secondary shaft and the blades 8002 at a lower angle of pitch. The interaction between the helical cam groove 8502 and the cam pin 8004, results in the blades 8002 being positioned in the radially inward and low pitch limited position, as limited by the cam pin 8004 pressing against the end of the cam groove 8502, as shown in FIGS. 33 and 35.

Increasing engine power and propeller rotational speed, increases the hydrodynamic loads acting aft of the blade primary shaft 8302, thus further increasing the bias on the blades 8002 towards a lower angle of pitch. Pressing the blades 8002 towards a higher angle of pitch are the centrifugal effect forces acting on the blade mass, which act directly to tend to move the blades in a radially outward direction. The constraints of the helical cam groove 8502 in contact with the cam pin 8004 requires that as the blade 8002 moves outwardly, it must also rotate to a higher angle of pitch. When the propeller rotational speed (RPM) is increased to a sufficient magnitude, the blade centrifugal force effect, tending towards higher pitch, exceeds the bias forces acting toward a lower pitch angle, i.e. that is derived from hydrodynamic loads and the springs, plus any friction and damping impedance, thereby causing the blades 8002 to move radially outward and, via the cam groove 8502, cam pin 8004 geometry, to be rotated towards a higher angle of pitch.

As the blades 8002 are caused to move radially outward and rotate toward a higher angle of pitch, the damping struts 8090 must increase in length as the blade secondary shafts 8402 move away, thus damping the movement of the blades both radially and rotationally.

Figure 36:
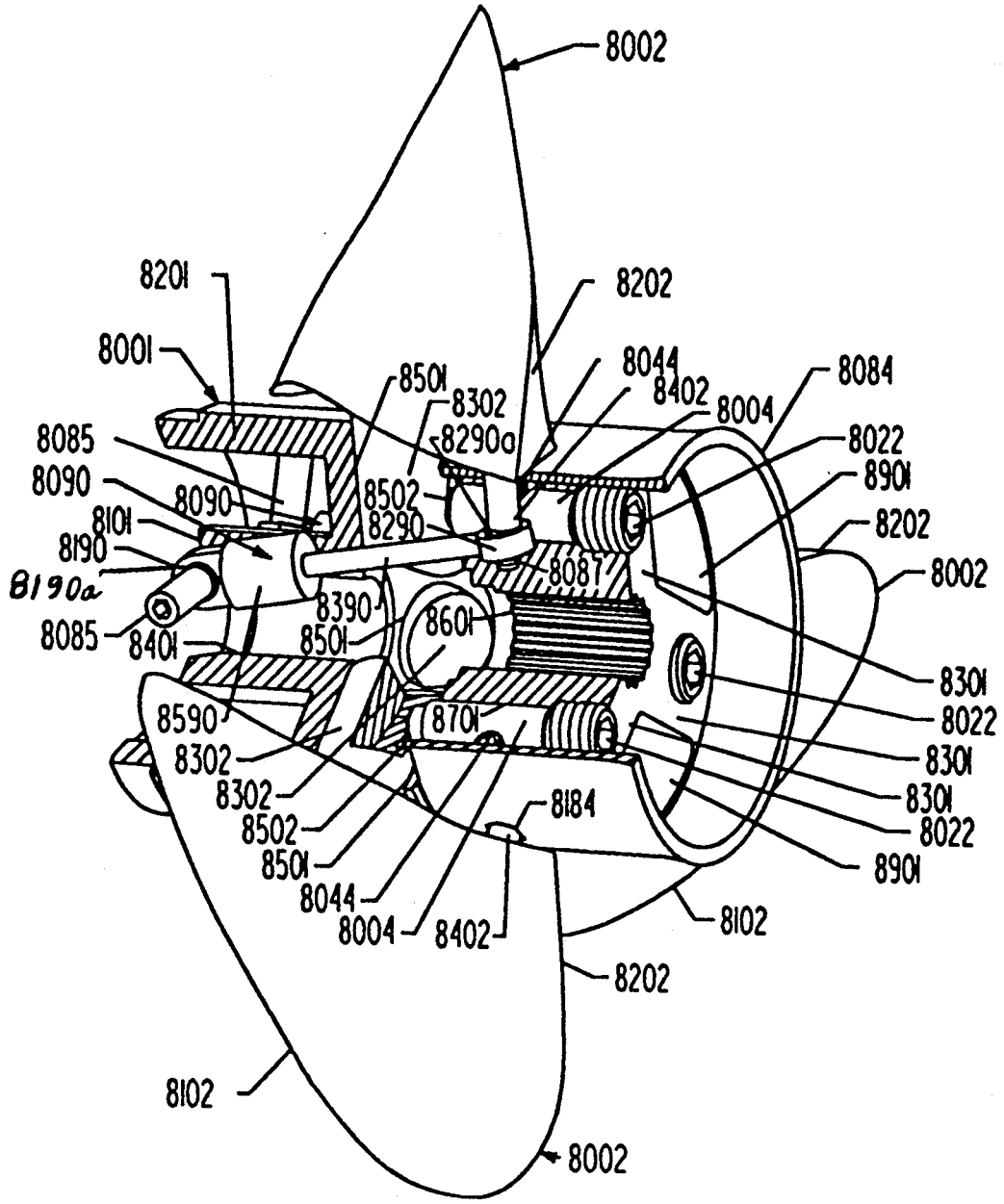
FIG. 36 is a random section isometric view of the propeller of FIG. 33, showing the internal parts in the high pitch limited position.

If the propeller rotational speed (RPM) is further increased, the blades will eventually move to their radially outward high pitch limit position as defined by the can pin 8004 pressing against the upper end of the cam groove 8502, or at a lower high pitch limited position as determined by the blade secondary shaft 8402 contacting the end of a high pitch stop adjustment screw 8044, as shown in FIGS. 34 and 36. This high pitch stop adjustment screw 8044 allows the maximum operating pitch of the propeller to be easily adjusted to the needs of each boat installation.

Upon a reduction in propeller RPM, the blade hydrodynamic loads in combination with any spring biasing tending to turn the blades toward a lower angle of pitch overcome the centrifugal torque towards higher pitch plus friction and damping impedance, and cause the blades to rotate toward a lower angle of pitch and to move radially inward, as a consequence of the cam groove 8502, cam pin 8004 connection. Upon a substantial reduction in propeller RPM, the blades 8004 eventually return to the low pitch limit position shown in FIGS. 33 and 35.

As the blades 8004 move radially inward and toward a lower angle of pitch, the damper struts 8090 are caused to retract in length, thus providing damping, as explained above. Depending upon the internal design of the damping strut, full damping, reduced damping or substantially no damping can be applied to the blade 8002 during radially inward, lower pitch angle motion.

The level of damping provided by the damping strut 8090 can be of a low value, to specifically reduce or eliminate blade flutter, or the level of damping can be increased significantly to substantially reduce the rate-of-change in pitch operational position of the propeller blades as discussed for the previous embodiments. In either event, the operation of the variable pitch propeller is greatly improved to avoid the losses in efficiency caused by oscillations and the resulting blade flutter.

The propellers of this invention are preferably constructed of corrosion resistant materials such as aluminum and/or bronze and/or stainless steel or other corrosion resistant metal, or impact resistant non-metals such as polycarbonates, acetals, or reinforced polymers.

I claim:

1. A variable pitch marine propeller comprising a hub case; drive securing means designed to secure the propeller to a rotating drive shaft on a boat, such that the propeller rotates with the drive shaft; a plurality of blades extending transversely outwardly from the hub case and rotatably secured to the hub case about a blade pivot axis transverse to the axis of the drive shaft, for pivotal movement about the blade pivot axis between two extreme angular pitch positions, a first lower, pitch position and a second, higher, pitch position; each blade comprising a hydrodynamic surface, having a leading edge, and a blade shaft extending from the hydrodynamic surface along the blade pivot axis to the hub case; the hydrodynamic surface being so formed, and the blade axis and hydrodynamic surface being so juxtaposed to each other and to the hub case, that the center of pressure of the blade during initial acceleration from low boat velocity, is located intermediate the pivot axis and the leading edge, such that the resultant hydrodynamic torque vector initially generated upon such acceleration of the propeller acts so as to tend to cause pivotal movement of the blade towards the higher pitch position; bias means operably connected between a blade and the hub case, tending to retain the blades in the first lower pitch position; centrifugal mass means, secured to the blades, the centrifugal mass means being located in such a position relative to the blades, that upon rotation of the propeller a centrifugal force is imparted to the blades tending to pivot the blades from the first, lower, pitch position to the second, higher, pitch position; and mechanical holding means operably connected to the blades to hold the blades against pivoting towards the second pitch position; such that the blades are caused to pivot towards the second higher pitch position when the net effect of the centrifugal force effect and the hydrodynamic torque effect is sufficient to overcome the bias means and the mechanical holding means.

2. The variable pitch marine propeller of claim 1, comprising coordination means operatively connected to each of the blades, such that movement of any one of the blades causes a proportional movement of the coordination means, whereby the movement of all of the blades is synchronized.

3. A variable pitch marine propeller comprising a hub case; drive securing means designed to secure the propeller to a rotating drive shaft on a boat, such that the propeller rotates with the drive shaft; a plurality of blades extending transversely outwardly from the hub case and rotatably secured to the hub case about a blade pivot axis transverse to the axis of the drive shaft, for pivotal movement about the blade axis between two extreme angular pitch positions; each blade comprising a hydrodynamic surface having a leading edge and a blade shaft extending along the blade pivot axis, centrifugal mass means secured to, and so juxtaposed to, each of the blades such that upon rotation of the propeller a centrifugal force is imparted to the blades tending to pivot the blades from a first, lower, pitch position to a second, higher, pitch position; and mechanical holding means operably connected to the blades to hold the blades against pivoting towards the second pitch position; such that the blades are caused to pivot towards the second higher pitch position when the net effect of the centrifugal force effect is sufficient to overcome the mechanical holding means.

4. The variable pitch marine propeller of claim 3, further comprising mechanical biasing means tending to maintain the blade in the first pitch position.

5. The variable pitch marine propeller of claim 4, wherein the mechanical biasing means comprises drive-torque connecting means operably connected between the blades and the drive securing means, whereby the application of power to the drive shaft tends to bias the blades towards a lower angular pitch position.

6. The variable pitch marine propeller of claim 4, wherein the mechanical biasing means comprises spring biasing means.

7. The variable pitch marine propeller of claim 6, wherein the spring biasing means comprises a compression spring operatively connected between a blade and the hub case, and designed to bias the blade towards the first pitch position.

8. The variable pitch marine propeller of claim 6, wherein the spring biasing means comprises a tension spring operatively connected between a blade and the hub case, and designed to bias the blade towards the first pitch position.

* * * * *